US007804477B2

(12) United States Patent
Sawada et al.

(10) Patent No.: US 7,804,477 B2
(45) Date of Patent: Sep. 28, 2010

(54) IMAGE DISPLAY APPARATUS AND IMAGE DISPLAY METHOD

(75) Inventors: Munenori Sawada, Suwa (JP); Kota Muto, Suwa (JP)

(73) Assignee: Seiko Epson Corporation (JP)

( * ) Notice: Subject to any disclaimer, the term of this patent is extended or adjusted under 35 U.S.C. 154(b) by 760 days.

(21) Appl. No.: 11/695,661

(22) Filed: Apr. 3, 2007

(65) Prior Publication Data

US 2007/0229443 A1 Oct. 4, 2007

(30) Foreign Application Priority Data

Apr. 3, 2006 (JP) ..... 2006-101948
Mar. 19, 2007 (JP) ..... 2007-069898

(51) Int. Cl.
*G09G 3/36* (2006.01)

(52) U.S. Cl. ..... 345/101; 345/87

(58) Field of Classification Search ..... 345/55–107, 345/204–214, 690–697
See application file for complete search history.

(56) References Cited

U.S. PATENT DOCUMENTS 5,748,277 A 5/1998 Huang
6,496,170 B1 * 12/2002 Yoshida et al. ..... 345/87
6,670,937 B1 * 12/2003 Tsuboyama et al. ..... 345/97
6,803,899 B1 * 10/2004 Masazumi et al. ..... 345/101
7,038,647 B2 * 5/2006 Shigeta et al. ..... 345/89
7,274,348 B2 * 9/2007 Izumi et al. ..... 345/87
7,358,948 B2 * 4/2008 Shiomi et al. ..... 345/89
7,420,538 B2 * 9/2008 Murao et al. ..... 345/101
2006/0139295 A1 * 6/2006 Eberhard et al. ..... 345/101
2006/0158410 A1 * 7/2006 Fujine ..... 345/89

* cited by examiner

*Primary Examiner*—David L Lewis
(74) *Attorney, Agent, or Firm*—Harness, Dickey & Pierce, P.L.C.

(57) ABSTRACT

An image display apparatus that displays an image on a display includes: a temperature measuring unit that measures temperatures of a plurality of display regions of the display; a determining unit that determines whether or not a temperature difference between one of the plurality of display regions and the other display regions is larger than a threshold value on the basis of the temperatures measured by the temperature measuring unit; a driving condition setting unit that sets a driving condition for displaying the image on the display according to image data of the image; a driving condition changing unit that, in a case when the determining unit determines that the temperature difference is larger than the threshold value, changes the set driving condition to a driving condition different from that in a case in which the temperature difference is determined to be equal to or smaller than the threshold value; and a display driving unit that drives the display under the driving condition changed by the driving condition changing unit and displays the image on the display.

12 Claims, 10 Drawing Sheets

PLANAR (P)
ALIGNMENT

FOCAL CONIC (F)
ALIGNMENT

HOMEOTROPIC (H)
ALIGNMENT

IMAGE DISPLAY APPARATUS AND IMAGE DISPLAY METHOD

BACKGROUND

1. Technical Field

The present invention relates to an image display apparatus and an image display method, and more particularly, to a technique suitable for an image display apparatus having a display whose characteristic changes depending on temperature.

2. Related Art

In recent years, among image display apparatuses that display various kinds of information as images, an image display apparatus having a non-volatile display is under development for practical use. Since the non-volatile display consumes electric power only at the time of rewriting, the power consumption of the non-volatile display is overwhelmingly small as compared with a normal display. Accordingly, since it is possible to make equipment having an image display apparatus small by reducing the capacity of a battery, the non-volatile display has been drawing attention as a display suitable for equipment, such as an electronic book.

As such non-volatile display, there is a display using cholesteric liquid crystal as a display material. Moreover, in the case of using the cholesteric liquid crystal, high-speed image rewriting can be realized using a DDS (dynamic drive scheme) driving method that is a cholesteric liquid crystal driving method disclosed in U.S. Pat. No. 5,748,277.

However, the viscosity of the display material of the non-volatile display easily changes depending on temperature, even though the display material of the non-volatile display is advantageous in that the power consumption thereof is small. That is, there is a problem in that the display material of the non-volatile display has temperature dependency that a display characteristic thereof easily changes depending on temperature. For this reason, in the case of driving cholesteric liquid crystal using the above-mentioned DDS driving method, the change of display characteristics depending on the temperature is large, as also disclosed in U.S. Pat. No. 5,748,277. Accordingly, it is necessary to control driving parameters, such as a voltage applied to the cholesteric liquid crystal, in the unit of temperature change of 1° C. or less, for example.

For this reason, it is necessary to cope with change of the display characteristic occurring due to the temperature difference in a case that was not a problem in the related art, that is, in a case when the temperature difference is found within a display region of the display regarding the temperature of cholesteric liquid crystal, such as a case when a heat source is disposed close to the display. Particularly in the case of a display using a passive driving method, the number of kinds of driving parameters is normally small as compared with a case of an active driving method. Accordingly, change to an optimal driving parameter corresponding to a place where the temperature difference is found is difficult. As a result, display different from original display is performed in a display region where the temperature is different, which causes a problem in that reproducibility of a displayed image is degraded. Particularly in the case when the temperature difference is so large, for example, there is a problem in that a corresponding part is displayed in a completely white or black color.

SUMMARY

An advantage of some aspects of the invention is that it provides an image display apparatus and an image display method of capable of performing image display with satisfactory reproduction even when a temperature difference occurs within a display area of a display.

In order to achieve the above object, according to an aspect of the invention, an image display apparatus that displays an image on a display includes: a temperature measuring unit that measures temperatures of a plurality of display regions of the display; a determining unit that determines whether or not a temperature difference between one of the plurality of display regions and the other display regions is larger than a threshold value on the basis of the temperatures measured by the temperature measuring unit; a driving condition setting unit that sets a driving condition for displaying the image on the display according to image data of the image; a driving condition changing unit that, in a case when the determining unit determines that the temperature difference is larger than the threshold value, changes the set driving condition to a driving condition different from that in a case in which the temperature difference is determined to be equal to or smaller than the threshold value; and a display driving unit that drives the display under the driving condition changed by the driving condition changing unit and displays the image on the display.

According to the configuration described above, even if a temperature difference larger than the threshold value occurs between one region and other regions, display with satisfactory reproduction can be obtained by changing a driving condition. Moreover, in the aspect of the invention, the driving condition includes application time of a voltage applied to each pixel of a display or a value of an applied voltage.

In the image display apparatus according to the aspect of the invention, it is preferable to further include a gradation setting unit that, in the case when the temperature difference is determined to be larger than the threshold value, changes and sets pixel gradation values, which are image data of pixels included in the image, to display gradation values which are image data of pixels included in an image displayed by the display driving unit. In addition, preferably, the driving condition changing unit changes the set driving condition to a driving condition that is set by the driving condition setting unit using the changed and set display gradation values as image data.

In this case, gradation values (pixel gradation values) of pixels forming an image to be displayed on the display are converted into gradation values (display gradation values) of pixels forming an image to be actually displayed in accordance with the temperature difference of the display region, and the display is driven under a driving condition corresponding to the converted display gradation value. Thus, temperature compensation for the image that is actually displayed is made by the converted display gradation value. As a result, image display with satisfactory reproduction can be performed on the display where the temperature difference occurs.

In this case, preferably, the gradation setting unit changes and sets the pixel gradation values to the display gradation values for image data displayed on all display regions of the display.

In the case when there is on the display a display region where the temperature difference is larger than the threshold value, a driving condition of the entire display can be actually changed by converting pixel gradation values into display gradation values for all image data of the display. Thus, by changing pixel gradation values with respect to all display regions to become a desirable driving condition in accordance with, for example, a temperature difference occurring in a display region, temperature compensation for an image that is actually displayed is made by the converted display gradation value. As a result, image display with satisfactory reproduction can be performed regardless of the temperature difference.

Alternatively, preferably, the gradation setting unit changes and sets the pixel gradation values to the display gradation values for image data displayed on either the one display region or the other display regions.

For example, in the case when the temperature of one display region changes while rising or falling and a temperature difference between the temperature and temperatures of the other display regions is larger than the threshold value, a pixel gradation value of image data of the entire display is converted into a display gradation value only for the one display region so as to change a driving condition of an image that is actually displayed on the corresponding display region. Thus, by converting pixel gradation values to display gradation values so as to become a desirable driving condition in accordance with, for example, a temperature difference occurring in a display region, temperature compensation for an image that is actually displayed is made by the converted display gradation value. As a result, image display with satisfactory reproduction can be performed regardless of the temperature difference.

Further, in the image display apparatus described above, preferably, the gradation setting unit changes and sets the display gradation values to display gradation values by which the number of gray-scale levels displayed is smaller than that in the case in which the temperature difference is determined to be equal to or smaller than the threshold value.

In the case when the temperature difference is larger than the threshold value, for example, in a display region where the temperature changes largely, it may be difficult to perform an original gradation display of an image. In this case, it is possible to reduce the number of displayed gray-scale levels through binary display (for example, display of only two gray-scale levels of white and black colors) or the like. In addition, by changing a halftone (for example, gray color) to a black or white color beforehand so as to prevent one character from becoming thick or thin, it is possible to appropriately display a character image even though it is difficult to realize antialiasing. As a result, an image with satisfactory reproduction can be displayed without being affected by the temperature difference.

Alternatively, preferably, the gradation setting unit changes and sets the pixel gradation values to the display gradation values on the basis of a table that specifies correspondence relationship between the pixel gradation values and the display gradation values.

Thus, on the basis of the specified table, it is possible to easily change and set the pixel gradation values to the display gradation values corresponding to the temperature difference. As a result, since it is possible to suppress a screen of a display from becoming too dark or too bright on the whole, it becomes possible to display an image with satisfactory reproduction regardless of the temperature difference.

Furthermore, in the image display apparatus described above, preferably, the gradation setting unit sets display gradation values different from those in the case in which the temperature difference is determined to be equal to or smaller than the threshold value.

The case in which the temperature difference is larger than the threshold value refers to a case in which the temperature difference between the temperature of the one display region and the temperatures of the other display regions is large. In this case, a driving condition is changed by changing display gradation values as compared with a case where the temperature difference is small. Thus, since it is possible to suppress the screen of a display from becoming too dark or too bright on the whole, it becomes possible to display an image with satisfactory reproduction regardless of the temperature difference.

Furthermore, in the image display apparatus described above, it is preferable to further include an image creating unit that creates changed pixel gradation values obtained by changing the pixel gradation values so as to be converted into the display gradation values set beforehand. In addition, preferably, the gradation setting unit performs the changing and setting by using the changed pixel gradation values as the pixel gradation values.

In this case, the display gradation values converted by the table corresponding to the temperature difference are always converted into the display gradation values set beforehand. Accordingly, the driving condition for driving the display is the same all the time. Thus, in the case when there is a limit in the number of kinds of driving conditions, temperature compensation can be effectively performed by setting display gradation values beforehand such that the driving conditions corresponding to the display gradation values become driving conditions corresponding to the number of kinds of driving conditions that is the limit.

Furthermore, in the image display apparatus described above, preferably, the driving condition setting unit calculates an average value of the temperatures, which are measured for the other display regions, excluding the measured temperature of the one display region determined that the temperature difference is larger than the threshold value, and sets a driving condition corresponding to the calculated average value as well as the image data of the image.

In this case, the driving condition is set corresponding to the average temperature of display regions excluding a display region where the temperature difference larger than the threshold value occurs as compared with the other display regions. Therefore, in all display regions, it is possible to drive the display under the driving condition suitable for each of the display regions. As a result, an image with satisfactory reproduction can be displayed on the display where the temperature difference larger than the threshold value occurs.

Furthermore, in the image display apparatus described above, preferably, the driving condition setting unit sets a driving condition corresponding to the image data from the driving conditions equal to or larger than the number of gray-scale display levels of an image displayed on the display.

Therefore, a driving condition corresponding to the temperature difference can be set from a plurality of driving conditions according to a display gradation value. As a result, an image with satisfactory reproduction can be displayed on the display where the temperature difference larger than the threshold value occurs.

Furthermore, in the image display apparatus described above, preferably, a display material of the display is a liquid crystal material showing a plurality of final alignment states, in which molecular alignments are different, in a final image display state. In addition, preferably, the display driving unit causes the alignment states of the molecular alignments to transition to transient alignment states different from the final alignment states and then drives the display using a driving method of selecting the final molecular alignment state during a selection period.

Furthermore, in the image display apparatus described above, preferably, the display uses cholesteric liquid crystal molecules as a display material.

As an example of the driving method, the DDS driving method for cholesteric liquid crystal may be mentioned, for example. In this case, homeotropic alignment corresponds to the transient alignment state. Then, the homeotropic alignment selectively transitions to a transient planer alignment during the selection period for selecting the final alignment state (planer alignment or focal conic alignment). Since the transition to the transient planer alignment can be performed within a short period of time, there is an advantage that a rewriting period can be greatly shortened. On the other hand, since it depends on the temperature whether or not the transition to the transient planer alignment can be performed, highly precise temperature compensation is required. Accordingly, application of the invention is so effective.

In addition, since the cholesteric liquid crystal is a display material that can be driven using the DDS driving method and a characteristic thereof largely changes with temperature, application of the invention is so effective.

According to another aspect of the invention, an image display method of displaying an image on a display includes: measuring temperatures of a plurality of display regions of the display; determining whether or not a temperature difference between one of the plurality of display regions and the other display regions is larger than a threshold value on the basis of the temperatures measured in the measuring of the temperatures; setting a driving condition for displaying the image on the display according to image data of the image; changing the set driving condition to a driving condition different from that in a case in which the temperature difference is determined to be equal to or smaller than the threshold value, in a case when the temperature difference is determined to be larger than the threshold value in the determining; and driving the display under the driving condition changed in the changing of the driving condition and displaying the image on the display.

In the image display method according to the aspect of the invention, it is possible to obtain the same operations and effects as the image display apparatus described above. In addition, in the image display method, a process for realizing each function of the image display apparatus may be added.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an image display apparatus according to an embodiment of the invention will be described in the following order.

(A) Functional configuration of an image display apparatus (B) DDS driving method for cholesteric liquid crystal (C) First example of temperature compensation in the present embodiment (D) Second example of temperature compensation in the present embodiment (E) Third example of temperature compensation in the present embodiment

(A) Functional Configuration of an Image Display Apparatus

Figure 1:
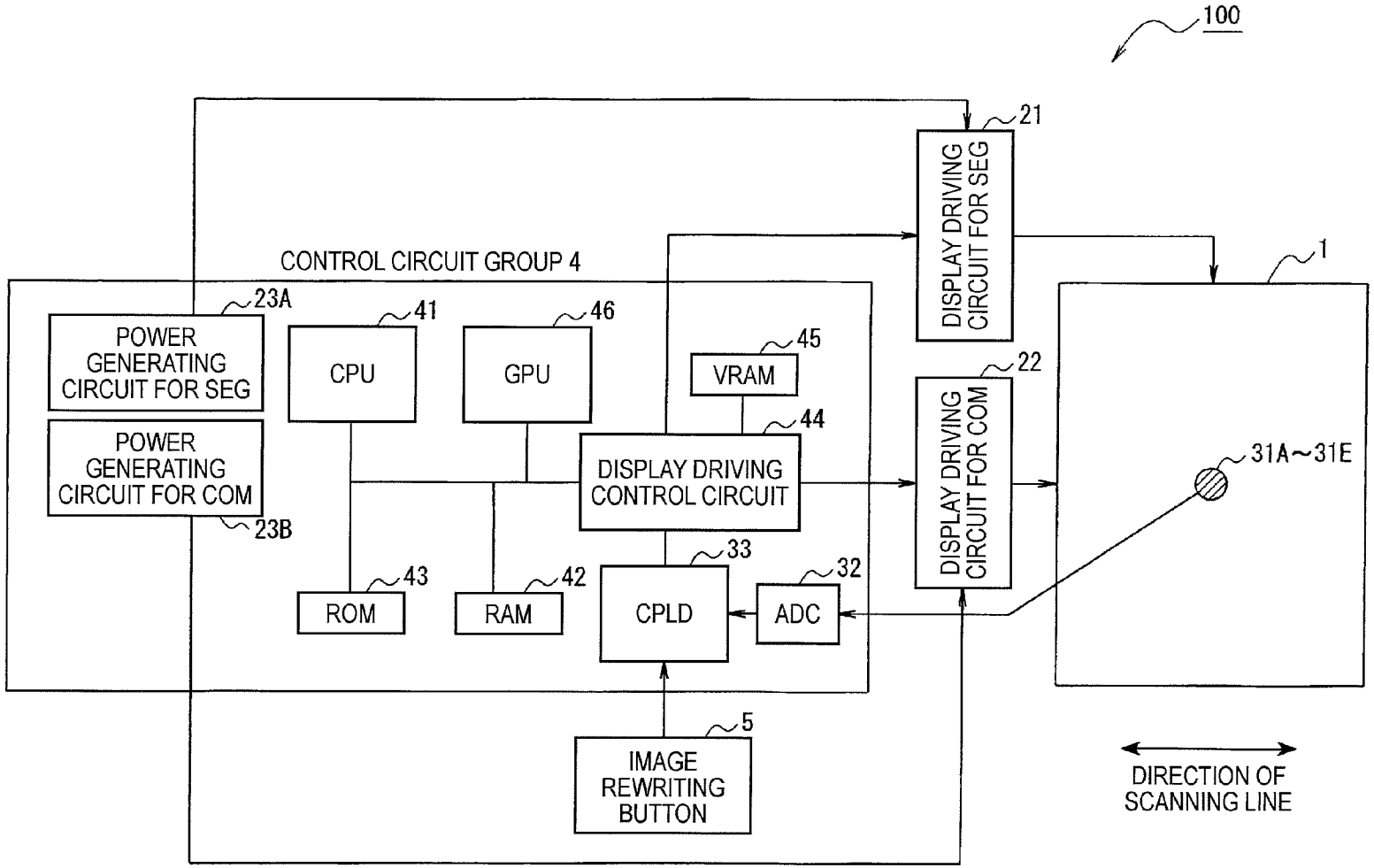
FIG. 1 is a block diagram illustrating the internal configuration of an image display apparatus an embodiment of the invention.

FIG. 1 is a block diagram illustrating the function configuration of an image display apparatus 100 according to the present embodiment. As shown in FIG. 1, the image display apparatus 100 is configured to include a display panel 1, a control circuit group 4, a display driving circuit 21 and a display driving circuit 22 that are respectively used as a driving circuit for segment (SEG) and a driving circuit for common (COM), and a rewriting button 5.

Figure 2A:
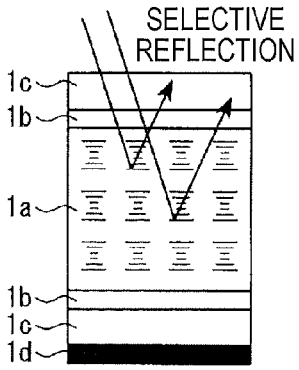
FIG. 2A is a view explaining an alignment state of cholesteric liquid crystal.
Figure 2B:
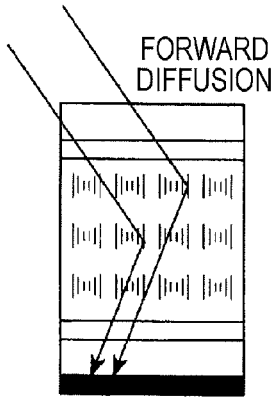
FIG. 2B is a view explaining an alignment state of cholesteric liquid crystal.
Figure 2C:
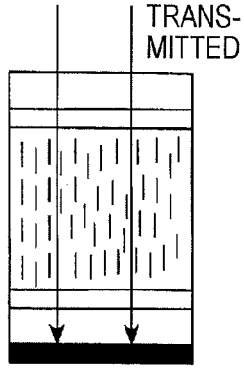
FIG. 2C is a view explaining an alignment state of cholesteric liquid crystal.

The display panel 1 has a non-volatile property, and cholesteric liquid crystal is used as a display material in the present embodiment. In addition, as shown in FIGS. 2A to 2C, a cholesteric liquid crystal layer 1*a* as a display material is interposed by a transparent electrode 1*b*, a glass substrate 1*c*, a light absorption layer 1*d*, and the like. Cholesteric liquid crystal molecules of the cholesteric liquid crystal layer 1*a* have reflectance varying according to the alignment state of the molecules. For example, in the case of planar alignment (hereinafter, simply referred to as 'P alignment') shown in FIG. 2A, a color of a reflected light is displayed because incident light is reflected. In addition, in the case of focal conic alignment (hereinafter, simply referred to as 'F alignment') shown in FIG. 2B, a black color is display because incident light is almost transmitted and the transmitted light is absorbed in the light absorption layer 1*d*. Therefore, by controlling the alignment state of a cholesteric liquid crystal molecule in each pixel region, it is possible to rewrite and change an image displayed on the display panel 1. The alignment state can be controlled by using a voltage that is applied to the cholesteric liquid crystal layer 1*a* by the transparent electrode 1*b*. However, even if the voltage is not applied, the above state is maintained because the alignment state is stable in the P alignment and the F alignment. Accordingly, a display image that is rewritten by voltage application is maintained without consuming electric power. The display panel 1 having such structure corresponds to a display defined in the appended claims.

Furthermore, homeotropic alignment (hereinafter, simply referred to as 'H alignment') shown in FIG. 2C illustrates a state in which a helical structure of cholesteric liquid crystal molecules is lost. In this case, since light is transmitted but the state is not stable, the homeotropic alignment exists only when a voltage is applied. The H alignment state will be described later in DDS driving.

Referring back to FIG. 1, the control circuit group 4 includes a temperature measuring unit that measures and stores the temperature of the display panel 1, a power generating circuit 23A for segment (SEG) and a power generating circuit 23B for common (COM) that respectively supply power to the display driving circuit 21 and the display driving circuit 22, and a display processing unit that performs processing for creating and displaying image data.

The temperature measuring unit is configured to include a CPLD (complex programmable logic device) 33 and an A/D converter (denotes as 'ADC' in FIG. 1) 32. The CPLD 33 operates on the basis of a program stored therein when the image rewriting button 5 is pressed by a user, and acquires temperature data from five temperature sensors 31A to 31E provided in the display panel 1.

Figure 3:
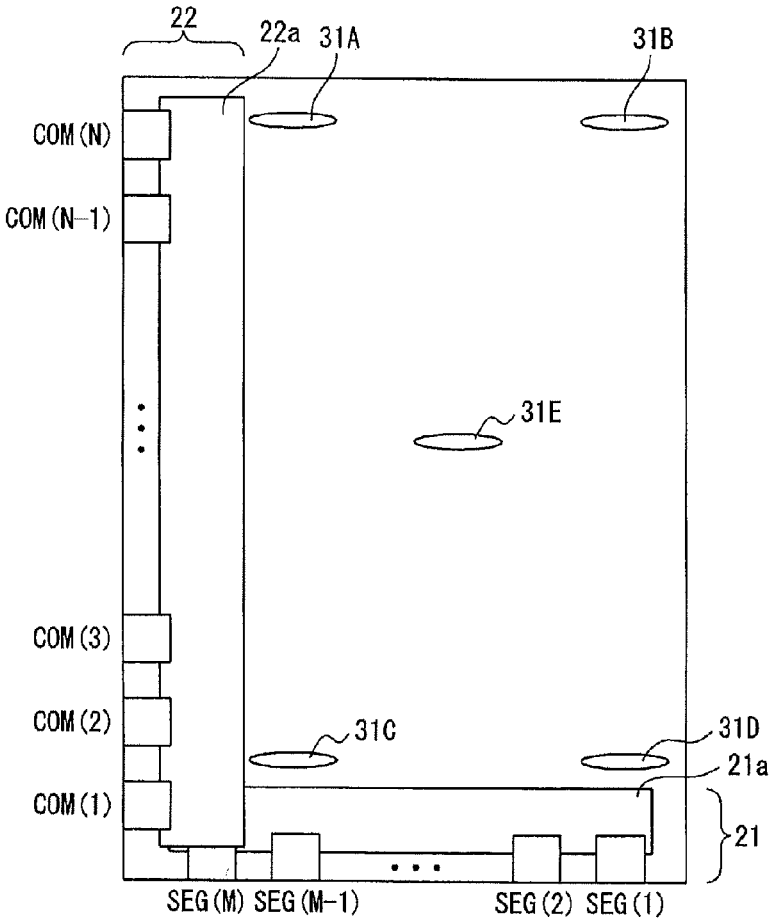
FIG. 3 is a plan view schematically illustrating a display panel.
Figure 4:
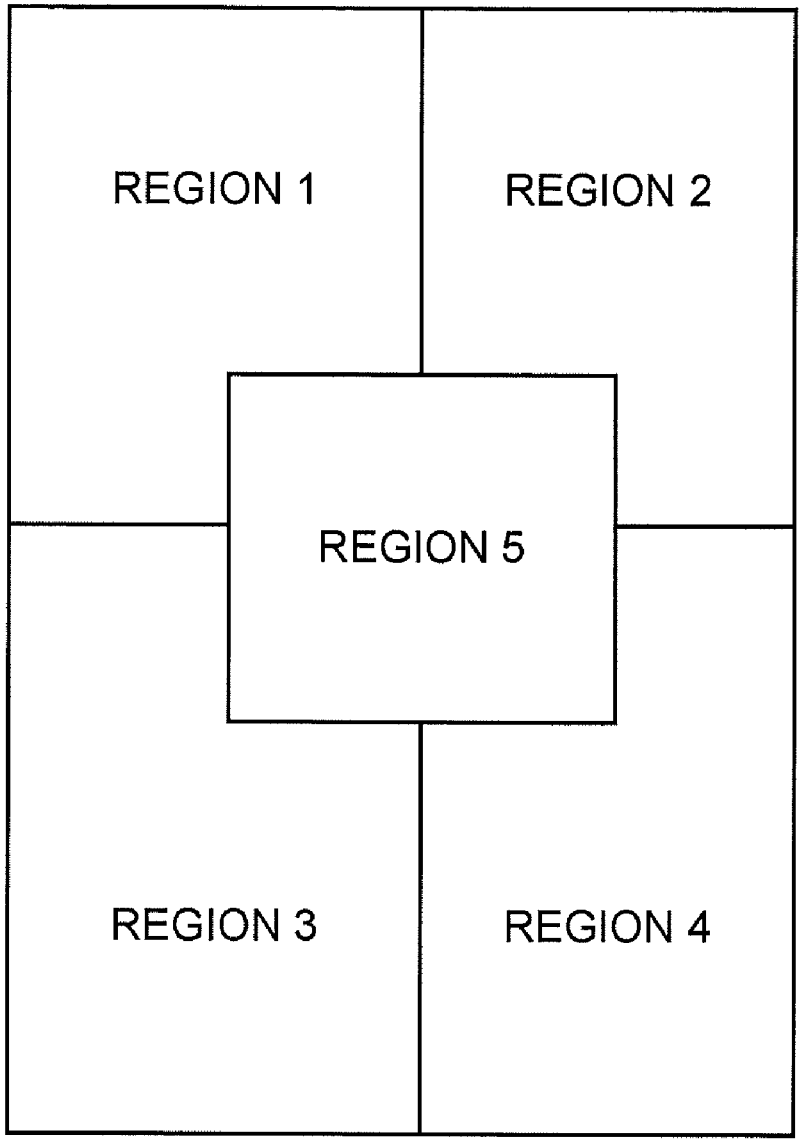
FIG. 4 is a plan view illustrating each region of a display panel whose temperature is measured.

As shown in FIG. 3, the temperature sensors 31A to 31E are fixed on a back surface of the display panel 1 so as to be differently positioned, such that the temperature sensors 31A to 31E measure the temperature of regions 1 to 5 in the display panel 1 as shown in FIG. 4. In the present embodiment, a thermistor in which resistance decreases as temperature rises is used as a temperature sensor. An analog signal from a thermistor is converted into temperature data digitalized by the A/D converter 32 and is then output to the CPLD 33. The CPLD 33 acquires temperature data on the regions 1 to 5 as described above and then outputs the acquired temperature data to a display driving control circuit 44.

The temperature measuring unit is configured to include a CPU (central processing unit) 41, a ROM (read-only memory) 43, a RAM (random access memory) 42, a GPU (graphics processing unit) 46, the display driving control circuit 44, and a VRAM (video random access memory) 45.

The CPU 41 controls the display driving control circuit 44, the ROM 43 stores program and data required for an operation of the CPU 41, and the RAM 42 is used as a work area for the operation of the CPU 41. In addition, in the present embodiment, the GPU 46 creates (renders) image data to be displayed on the display panel 1, and the created image data is stored in a predetermined region of the VRAM 45 through the display driving control circuit 44. Thus, since the CPU 41 and the GPU 46 performs predetermined operations, the display processing unit has functions as a determining unit, a driving condition setting unit, a driving condition changing unit, a gradation setting unit, and an image creating unit that are defined in the appended claims. The functions of the above units are executed by the constituent components, respectively. In addition, the above temperature measuring unit corresponds to a temperature measuring unit defined in the appended claims, and the above display driving circuits 21 and 22 correspond to a display driving unit defined in the appended claims.

When a command of rewriting an image is output from the CPU 41, the display driving control circuit 44 determines whether or not a temperature difference exceeds a threshold value on the basis of the temperature data acquired from the temperature sensors 31A to 31E. Then, the display driving control circuit 44 decides an appropriate driving condition corresponding to the determination result and then outputs the driving condition to the display driving circuits 21 and 22.

In the present embodiment, the driving condition refers to a condition for specifying a voltage value of a driving voltage waveform applied to liquid crystal corresponding to each pixel of the display panel 1, application time, and the like. Moreover, in the image display apparatus 100, a correspondence table for deciding a driving condition is held. The correspondence table is a table showing the correspondence relationship between a gradation value (hereinafter, referred to as an 'image gradation value') that each pixel has as image data of each pixel and a gradation value (hereinafter, referred to as a 'display gradation value') for deciding an effective voltage value of a driving voltage waveform applied when rewriting each pixel. In addition, in the correspondence table, the temperature of the display panel 1 is set as a parameter and one display gradation value corresponds to one pixel gradation value. In the present embodiment, the correspondence table is stored in the ROM 43 (refer to FIG. 1). Therefore, when a command of rewriting an image is output from the CPU 41, the display driving control circuit 44 refers to the correspondence table according to the acquired temperature data and determination result and then converts a pixel gradation value to a display gradation value in order to decide a driving condition.

A display gradation value determines a driving voltage waveform having an effective voltage value (hereinafter, also referred to as 'Selection voltage') that is to be applied during a selection period (referred to as 'Selection period' in the DDS driving method to be described later) while selection and determination of either the P alignment or the F alignment with respect to final molecule alignment of cholesteric liquid crystal is performed. Accordingly, in this case, the 'Selection voltage' is equivalent to a driving condition. In addition, in the present embodiment, sixteen kinds of effective voltage values (Selection voltages) are prepared, which will be described later. Therefore, a 'Selection voltage' is selected from the sixteen kinds of effective voltage values in correspondence with the converted display gradation value.

Moreover, the display driving control circuit 44 also performs processing for converting image data created in the GPU 46 into binary data in correspondence with the determination result, which will be described later. At the time of this processing, in the VRAM 45, the image data transmitted from the GPU 46 to the display driving control circuit 44 is loaded to be used as a work area when performing processing for conversion to binary data.

In the present embodiment, it is assumed that the number of gray-scale levels of an image displayed on the display panel 1 is four, such that four kinds of image data (pixel gradation values) are expressed for each pixel. Therefore, image data output from the CPU 41 to the display driving control circuit 44 is data corresponding to four kinds of driving conditions.

Further, in the present embodiment, the pixel gradation values indicate reflectances of four equal parts, when the pixel gradation value is expressed as a value (also referred to as 'normalized reflectance') normalized by setting a state (white state) where the reflectance of a display screen of the display panel 1 is highest as '1' and the lowest state (black state) as '0'. That is, the pixel gradation values are assumed to be values corresponding to the normalized reflectances (0, ⅓, ⅔, 1) equivalent to four gradation display. Since pixel gradation values corresponding to the four gradations are values corresponding to reflectance or transmittance of pixels forming an image that is actually displayed on a display, the pixel gradation value is determined by a display material used in the display.

When a driving condition corresponding to each pixel of the display panel 1 is output from the display driving control circuit 44, the display driving circuits 21 and 22 generate a driving voltage waveform specified on the basis of the corresponding driving condition and apply the generated driving voltage waveform to each pixel of the display panel 1. In the present embodiment, a display image of the display panel 1 is rewritten using a known passive driving method, in which liquid crystal is driven by a voltage applied between electrodes disposed to cross each other, as a method for driving the display panel 1, that is, using the DDS driving method disclosed in U.S. Pat. No. 5,748,277.

Specifically, in the present embodiment, the display driving circuit 21 for segment is configured to include 'M' data lines (not shown) extending longitudinally in the plane of the display panel 1 and 'M' segment drivers SEG(1) to SEG(M) that apply driving voltage waveforms to pixels corresponding to the 'M' data lines, as shown in FIG. 3. In addition, in FIG. 3, reference numeral 21*a* denotes a serial/parallel conversion circuit that supplies to the 'M' segment drivers driving voltage waveforms serially transmitted from the display driving control circuit 44.

Furthermore, the display driving circuit 22 for common is configured to include 'N' scanning lines (not shown) extending horizontally in the plane of the display panel 1 and 'N' common drivers COM(1) to COM(N) that apply scanning pulses for sequentially selecting one scanning line such that the above-mentioned driving voltage waveform is applied to each pixel corresponding to one of the 'N' scanning lines, as shown in FIG. 3. In addition, in FIG. 3, reference numeral 22*a* denotes a serial/parallel conversion circuit that supplies, to the 'N' common drivers, an instruction to generate scanning pulses serially transmitted from the display driving control circuit 44.

The display driving circuit 21 includes a PWM circuit capable of performing PWM (pulse width modulation) and modulates the pulse width of a voltage pulse that is a driving voltage waveform applied to pixels to be driven. Accordingly, the pulse width that is output time of a predetermined voltage value is controlled by the PWM circuit, and as a result, the sixteen kinds of effective voltage values may be output from the display driving circuit 21. Therefore, driving voltage waveforms having the pulse widths corresponding to effective voltage values corresponding to the four driving conditions are applied to respective pixels at the time of rewriting of an image.

(B) DDS Driving Method for Cholesteric Liquid Crystal

Figure 5:
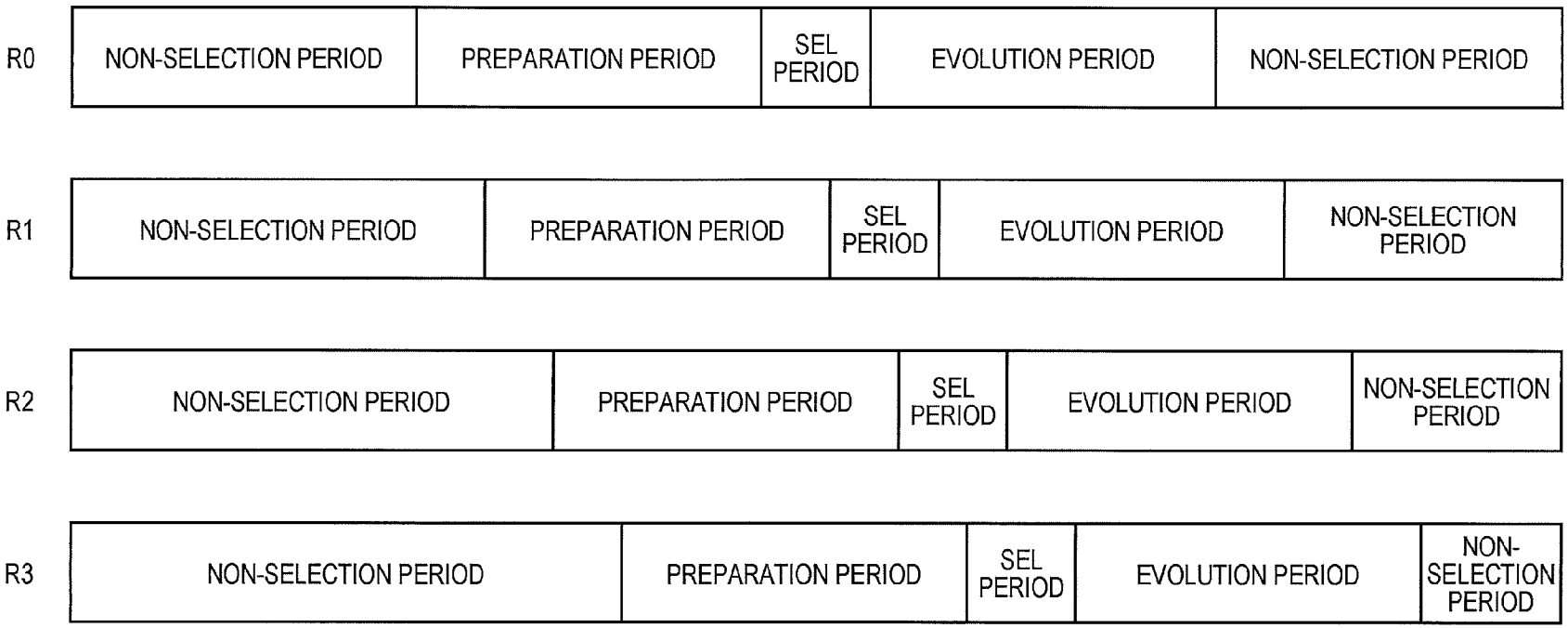
FIG. 5 is a view explaining a driven state of each pixel in DDS driving.

Next, the DDS driving method, which is a driving method used in the present embodiment, in the display panel 1 having the above-described driving circuit will be described with reference to FIG. 5. In FIG. 5, R0, R1, R2, and R3 each indicate one scanning line and also indicate the type of a voltage applied to all pixels existing on the corresponding scanning line and elapsed time of the voltage application. As shown in FIG. 5, each of the R0, R1, R2, and R3 is classified into four periods, that is, a Non-Selection period, a Preparation period, a Selection period (Sel period in FIG. 5), and an Evolution period according to the type of an applied voltage applied to each pixel.

The Non-Selection period is a period while a voltage that does not change the state of liquid crystal is being applied, and the Preparation period is a period while an effective voltage that causes liquid crystal under the P alignment or F alignment to be aligned in the H alignment state is being applied. In addition, the Selection period is a period while a voltage for selecting a final display state (selecting either the F alignment or the P alignment after rewriting) is being applied to the liquid crystal under the state of the H alignment. The Evolution period is a period while a voltage that causes the final display state selected during the Selection period to be fixed is being applied.

Each of the common drivers COM(1) to COM(N) applies a predetermined voltage waveform to a corresponding scanning line according to the above-mentioned period. Referring to FIG. 5, after applying a voltage of the Non-Selection period to all scanning lines, a voltage of the Preparation period is first applied to the scanning line R0, and then predetermined voltages of the Selection period and Evolution period are sequentially applied to the scanning line. Then, after the voltage applied to the scanning line R0 has shifted to the Preparation period, the voltage of Preparation period is also applied to the scanning line R1 by shifting timing by the Selection period, and then a voltage of each period is sequentially applied in the same manner as in the case of the scanning line R0. Then, in the same manner, a predetermined driving voltage waveform is output from the common drivers so that a predetermined voltage is applied to the sequential scanning lines R2 and R3 by shifting timing by Selection period.

Each of the segment drivers SEG(1) to SEG(M) applies a signal corresponding to image data to a corresponding data line for each scanning line, thereby selecting a final display state of a pixel that is in the Selection period at the time of the signal application. Thus, the Selection period sequentially proceeds to each pixel without overlapping in a plurality of pixels. As described above, by shifting in parallel a plurality of pixels by only the Selection period, pixels can be sequentially rewritten every Selection period.

Moreover, in the DDS driving method, it is selected whether to maintain the H alignment without proceeding up to a state of the P alignment or the F alignment during the Selection period or to proceed to a state in which twisting of a helical structure called transient planar alignment (TP alignment: refer to FIGS. 6A and 6B) is slightly loose. For this reason, the Selection period is as short as, for example, about 1 millisecond in the DDS driving method, while several tens of milliseconds are needed in the Selection period in a known driving method in which a state proceeds up to the state of the P alignment or the F alignment during the Selection period. As a result, in the DDS driving method, high-speed rewriting processing is possible. In addition, the length of the Selection period is set according to the temperature of the display panel 1 at the time of rewriting of an image, and the length of the Selection period is not changed during the rewriting operation of an image. In addition, the Selection period is set to be long if the temperature of the display panel 1 is low. The Selection period is equivalent to a selection period defined in the appended claims.

Next, it will be described about a transition process of alignment state of cholesteric liquid crystal in the DDS driving method. As shown in FIG. 6A, first, a voltage that causes liquid crystal under the P alignment or the F alignment to be aligned in the H alignment state shown in FIG. 2C is applied during the Preparation period. Thereafter, a voltage for selecting a final display state (selecting either the F alignment or the P alignment after rewriting) is applied during the Selection period. At this time, for example, it is selected whether to maintain the H alignment by applying an effective voltage value corresponding to a display gradation value or to proceed to a state in which twisting of a helical structure called the transient planar alignment (TP alignment) is slightly loose. In addition, a mixture rate of the H alignment and the TP alignment is controlled for each pixel corresponding to an effective voltage value, which is applied, in a liquid crystal molecule level, thereby realizing a gradation display including intermediate gradation by means of area gradation. In addition, a voltage that causes the final display state selected during the Selection period to be fixed is applied in the Evolution period.

As a result, the H alignment in the Selection period is maintained, but the alignment finally transitions to the P alignment when a voltage is not applied. On the other hand, liquid crystal molecules under the TP alignment transition to the F alignment during the Evolution period and are then finally fixed to the F alignment. That is, an image displayed on the display panel 1 can be rewritten by the effective voltage value applied to pixels in the Selection period. In addition, a white display is obtained if all liquid crystal molecules of one pixel are in the state of the P alignment, and a black display is obtained if all liquid crystal molecules of one pixel are in the state of the F alignment. Moreover, if the P alignment and the F alignment are mixed, a gray color corresponding to a mixture rate thereof is displayed.

(C) First Example of Temperature Compensation in the Present Embodiment

In the image display apparatus 100 according to the present embodiment, in the case when the temperature difference among the regions 1 to 5, which are five display regions of the display panel 1 shown in FIG. 4, occurs due to a heating source existing inside or outside the image display apparatus 100, the viscosity of cholesteric liquid crystal positioned at the regions 1 to 5 is different. In this case, if a driving voltage waveform specified by a display gradation value set corresponding to one temperature is applied to each pixel to perform rewriting driving for the display panel 1, an effective voltage value different from that to be originally applied is applied to each pixel during the Selection period. As a result, it is difficult to correctly display an image.

Therefore, first, in the first example of temperature compensation performed by the image display apparatus according to the present embodiment, it is possible to perform image display with satisfactory reproduction by executing processing for changing an effective voltage value, which is applied, corresponding to the temperature of each of the regions 1 to 5 of the display panel 1. This processing will now be described referring to a flow chart shown in FIG. 7. In addition, the CPU 41 starts operating when the image rewriting button 5 is pressed and then the started CPU 41 controls the display driving control circuit 44 or the like according to a predetermined program, such that the processing is executed.

If the processing starts, first, in step S101, a process of detecting temperatures from thermistors as the temperature sensors 31A to 31E is performed. Then, in step S102, a process of calculating the average temperature from the detected temperatures is performed. Here, the average temperature is assumed to be a simple arithmetic average of the temperatures from the five thermistors.

Then, in step S103, a process of setting a Selection period and a reference table corresponding to the average temperature is performed. In step S103, the average temperature in driving the display panel 1 is obtained from the acquired temperature data as described above, and the Selection period for using the DDS driving method is set corresponding to the average temperature as described above. In addition, a correspondence table stored beforehand in the ROM 43 is set as the reference table. The reference table will be described later.

Thereafter, in step S104, a process of calculating a temperature difference among the detected temperatures is performed. In the present embodiment, the deviation from the average temperature calculated in step S102 is calculated and the calculated deviation is set as the temperature difference. Alternatively, a value obtained by dividing the deviation by the average temperature may be calculated as the temperature difference.

Then, in step S105, a process of determining whether or not the calculated temperature difference is larger than a threshold value is performed. Accordingly, it is possible to specify a region where the temperature is greatly different from the average temperature. In addition, the image display apparatus 100 stores information data of threshold value or calculation expressions for the purpose of calculation of the temperature difference and comparison with the threshold value. Moreover, the process of calculating the temperature difference and the process for comparison with the threshold value and determination in step S104 to S105 are equivalent to processing performed by a determining unit defined in the appended claims.

If it is determined that the temperature difference is equal to or smaller than the threshold value in step S105 (NO), the temperature of the display panel 1 is approximately uniform over the entire five regions. Accordingly, in this case, change of the correspondence table to be described later is not performed, proceeding to step S114. Then, in step S114, a process of converting image data expressed by a pixel gradation value into a display gradation value indicating a driving condition is performed using the reference table, proceeding to step S115. In step S115, a Selection voltage corresponding to the converted display gradation value is selected to set the driving condition, driving voltage waveforms specified by the set driving condition are sequentially applied during the Selection period of each pixel, thereby performing a process of rewriting an image.

On the other hand, if it is determined that the temperature difference is larger than the threshold value (step S105: YES), a process of distinguishing the regions 1 to 5, which are shown in FIG. 4, in the image data that is transmitted from the GPU 46 and is stored in the VRAM 45 is performed in step S106. Specifically, for example, the regions 1 to 5 can be distinguished by specifying the positions of segment driver and common driver that apply a voltage to pixels in each region.

Subsequently, in step S107, a process of selecting one of the regions 1 to 5 is performed. Then, in step S108, it is determined whether or not the temperature difference between the temperature of the selected region and the average temperature is equal to or larger than the threshold value. If it is determined that the temperature difference is smaller than the threshold value (NO), the process proceeds to step S112. In step S112, image data (pixel gradation value) corresponding to pixels in the selected one region is converted to a display gradation value by using a reference table as a correspondence table. Data indicating the converted display gradation value is stored in the VRAM 45 for each selected region.

On the other hand, if it is determined that the temperature difference is equal to or larger than the threshold value (step S108: YES), the process proceeds to step S109. In step S109, it is determined whether or not the temperature difference occurs toward a high-temperature side. Then, if it is determined that the temperature difference occurs toward the high-temperature side (YES), a correspondence table having temperature, which is obtained by setting the average temperature high, as parameter temperature is selected in step S110. On the other hand, if it is determined that the temperature difference does not occur toward the high-temperature side (NO), a correspondence table having temperature, which is obtained by setting the average temperature low, as parameter temperature is selected in step S111. Then, in step S112, the image data (pixel gradation value) corresponding to pixels in the selected one region is converted to a display gradation value by using the selected correspondence table, and the data indicating the converted display gradation value is stored in the VRAM 45 for each selected region.

Figure 8:
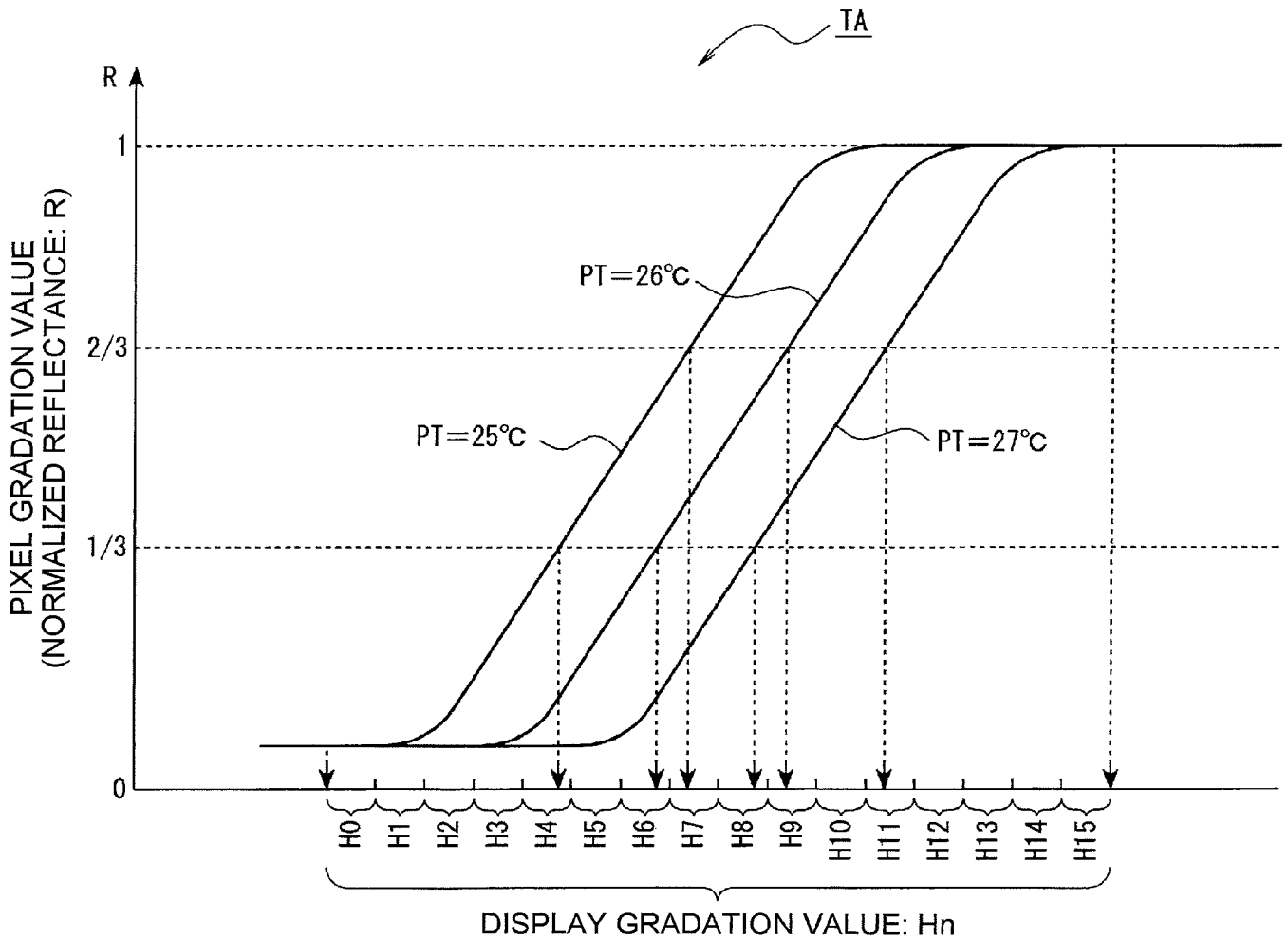
FIG. 8 is a view illustrating a correspondence table that specifies the correspondence relationship between a pixel gradation value and a display gradation value.

Here, a correspondence table TA and a reference table selected in the example will now be described. FIG. 8 is a view illustrating an example of the correspondence table TA. In FIG. 8, the correspondence relationship between a pixel gradation value and a display gradation value during one Selection period that is selected is specified using temperature PT of the display panel 1 as a parameter. In the correspondence table shown in FIG. 8, cases in which the temperature PT of the display panel 1 is 25° C., 26° C., and 27° C. are illustrated as examples. A vertical axis indicates a normalized reflectance R as a pixel gradation value, and a horizontal axis indicates sixteen kinds of display gradation values Hn (n=0 to 15) used as values for determining an effective voltage value that is applied to a pixel in order to obtain the normalized reflectance. Here, the display gradation value Hn is set such that an effective voltage value gradually increases as a value of 'n' increases. Accordingly, the correspondence table TA also indicates a so-called VR characteristic curve, which illustrates characteristics between the brightness of a display and a voltage, using the temperature PT as a parameter.

In addition, the correspondence table TA shown in FIG. 8 specifies a correspondence table in the case when the average temperature of the display panel 1 is 26° C. Accordingly, a correspondence table specifying the correspondence relationship between each pixel gradation value and each display gradation value specified by the parameter temperature PT=26° C. is a reference table. In the reference table, the correspondence relationship between the pixel gradation value and the display gradation value is specified to be constant all the time without depending on the temperature of the display panel 1. Moreover, in the correspondence table TA, the correspondence relationship between each pixel gradation value and each display gradation value is specified corresponding to the temperature change of the display. In FIG. 8, correspondence tables when the parameter temperature is 25° C. and 27° C. are shown as examples. Accordingly, in steps S110 and S111, unevenness of gradation display occurring due to a difference between the average temperature of the display panel 1 and an actual temperature of the display region is corrected by selecting a correspondence table according to the temperature difference of the display panel 1.

For example, in the case when the temperature difference occurs toward the high-temperature side in step S109, actual temperature of liquid crystal is higher than the average temperature in a corresponding region of the display panel 1. Accordingly, the Selection period is set to be longer than a value that is to be set for the actual temperature of liquid crystal. As a result, the state transitions to the TP alignment during the Selection period, which causes a black display on the whole (changes to the F alignment). Then, assuming that the average temperature obtained in step S102 is 26° C., a correspondence table having temperature (for example, 27° C.) higher than 26° C. as the parameter temperature PT is selected to increase an effective voltage value (step S110).

In contrast, in the case when the temperature difference occurs toward a low temperature side in step S109, actual temperature of liquid crystal is lower than the average temperature in a corresponding region of the display panel 1. Accordingly, the Selection period is set to be shorter than the value that is to be set for the actual temperature of liquid crystal. As a result, since the state cannot transition to the TP alignment during the Selection period, a white display on the whole is obtained (changes to the P alignment). Then, assuming that the average temperature obtained in step S102 is 26° C., a correspondence table having temperature (for example, 25° C.) lower than 26° C. as the parameter temperature PT is selected to decrease the effective voltage value (step S111).

It depends on the length of the Selection period set in an operation of rewriting an image, a structure of the display panel 1, and a display material how much the parameter temperature PT needs to be increased or decreased with respect to the average temperature. In addition, preferably, a display state is measured beforehand by applying a predetermined temperature difference with respect to the average temperature of the display panel and then it is set beforehand how much the parameter temperature PT needs to be increased or decreased on the basis of the measurement result. In addition, the temperature measured by each of the temperature sensors 31A to 31E may be set as parameter temperature.

Then, in step S112, a process of converting a pixel gradation value to a display gradation value is performed using the selected correspondence table. In the present embodiment, as shown in FIG. 8, one pixel gradation value (normalized reflectance) is converted to one display gradation value. For example, in the case of a correspondence table in which the temperature TP=27° C. is selected, four kinds of display gradation values (H0, H8, H11, H15) are selected. Then, the display driving control circuit 44 outputs 4-bit data indicating the type of each of the display gradation values (H0, H8, H11, H15) to the display driving circuit 21, as data of a Selection voltage applied to an object pixel during the Selection period. Furthermore, in the case of a correspondence table in which the temperature TP=25° C. is selected, four kinds of display gradation values (H0, H4, H7, H15) are selected. Moreover, in the case of using a reference table, the display gradation value is always changed and set to the four kinds of values (H0, H4, H7, H15) regardless of the average temperature.

Then, in step S113, it is determined whether or not a region that is not selected exists. If it is determined that a region that is not selected exists (YES), the process returns to step S107 to select one region that is not selected and then repeat the processes in step S107 to step S113. Then, if it is determined that a region that is not selected does not exist (NO), the process proceeds to step S115.

In step S115, a driving condition is set in each of the regions 1 to 5 by selecting a corresponding Selection voltage with respect to a display gradation value obtained by converting image data (pixel gradation value) of each region. Then, a driving voltage waveform specified by the set driving condition is sequentially applied during the Selection period of each pixel, thereby performing processing for rewriting an image. Thus, processing in the first example is completed.

As a result, in the case when the temperature difference among the regions 1 to 5 of the display panel 1 is large, an appropriate driving condition cannot be obtained from a correspondence table selected corresponding to the average temperature because the temperature of a liquid crystal material, which is a display material in a region having a high temperature difference, is different from the average temperature. For this reason, an image becomes white or dark. However, in the example described above, it is possible to prevent the image from becoming white or dark by changing a correspondence table selected with respect to the region where the high temperature difference occurs. As a result, since an image with satisfactory reproduction can be displayed, it becomes possible to reproduce precise and natural gradation.

Figure 6B:
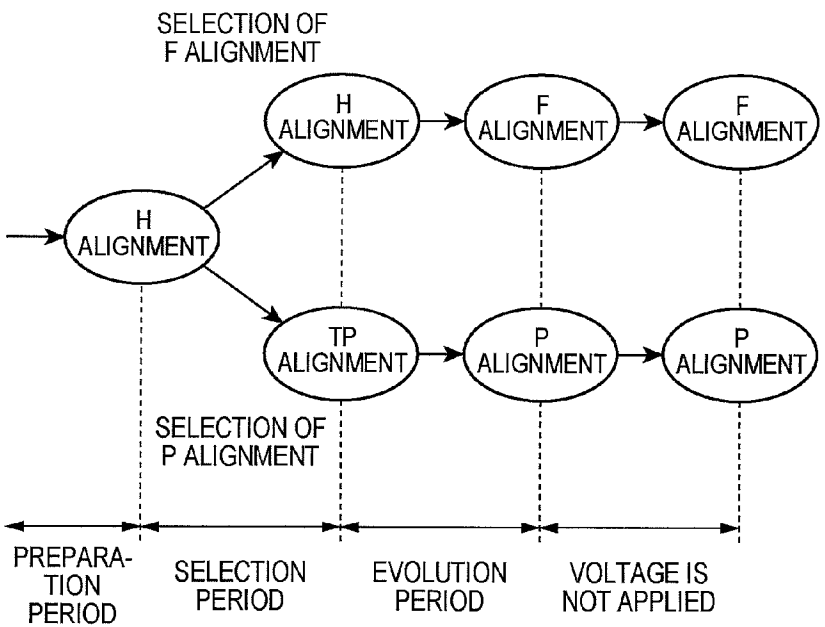
FIG. 6B is a view illustrating transition of an alignment state of cholesteric liquid crystal.
Figure 6A:
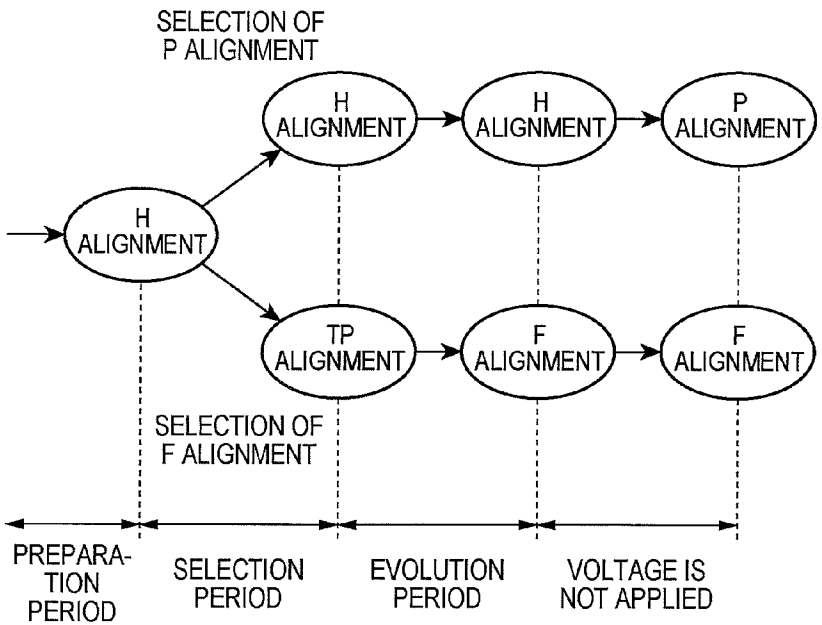
FIG. 6A is a view illustrating transition of an alignment state of cholesteric liquid crystal.

Furthermore, the DDS driving method is not limited to the method illustrated in FIG. 6A but includes a case of selecting an alignment state as shown in FIG. 6B. The case shown in FIG. 6B is the same as the case shown in FIG. 6A until the Selection period. However, in the case shown in FIG. 6B, a voltage applied during the Evolution period is lower than that in the case shown in FIG. 6A. That is, transition of an alignment state during the Evolution period is different from that in the case shown in FIG. 6A. Specifically, the H alignment maintained during the Selection period transitions to the F alignment and the TP alignment transitioned during the Selection period transitions to the P alignment, which is maintained as a final alignment state.

Accordingly, this case is opposite to that described above. That is, in the case when the temperature difference occurs toward the low-temperature side, it is not possible to transition to the TP alignment during the Selection period, resulting in a black display on the whole (changing to the F alignment). Therefore, by decreasing an effective voltage value by selecting a correspondence table having low parameter temperature such that transition to the TP alignment occurs easily, the display image can become entirely bright. As a result, precise and natural gradation can be reproduced. On the other hand, in the case when the temperature difference occurs toward the high-temperature side, the state transitions to the TP alignment during the Selection period, resulting in a white display on the whole (changing to the P alignment). Therefore, by increasing an effective voltage value by selecting a correspondence table having high parameter temperature such that transition to the TP alignment occurs easily, the display image can become entirely dark. As a result, precise and natural gradation can be reproduced.

(D) Second Example of Temperature Compensation in the Present Embodiment

In the first example, it has been described about a processing method in which a pixel gradation value is set to be changed to a display gradation value by using a correspondence table having temperature as a parameter and then the temperature difference between the average temperature and actual temperature of liquid crystal in each display region of a display panel is corrected. Next, in a second example of the present embodiment, temperature correction processing is performed by changing a pixel gradation value to a display gradation value using a gamma value to be described later. This processing will now be described referring to a flow chart shown in FIG. 9.

Figure 7:
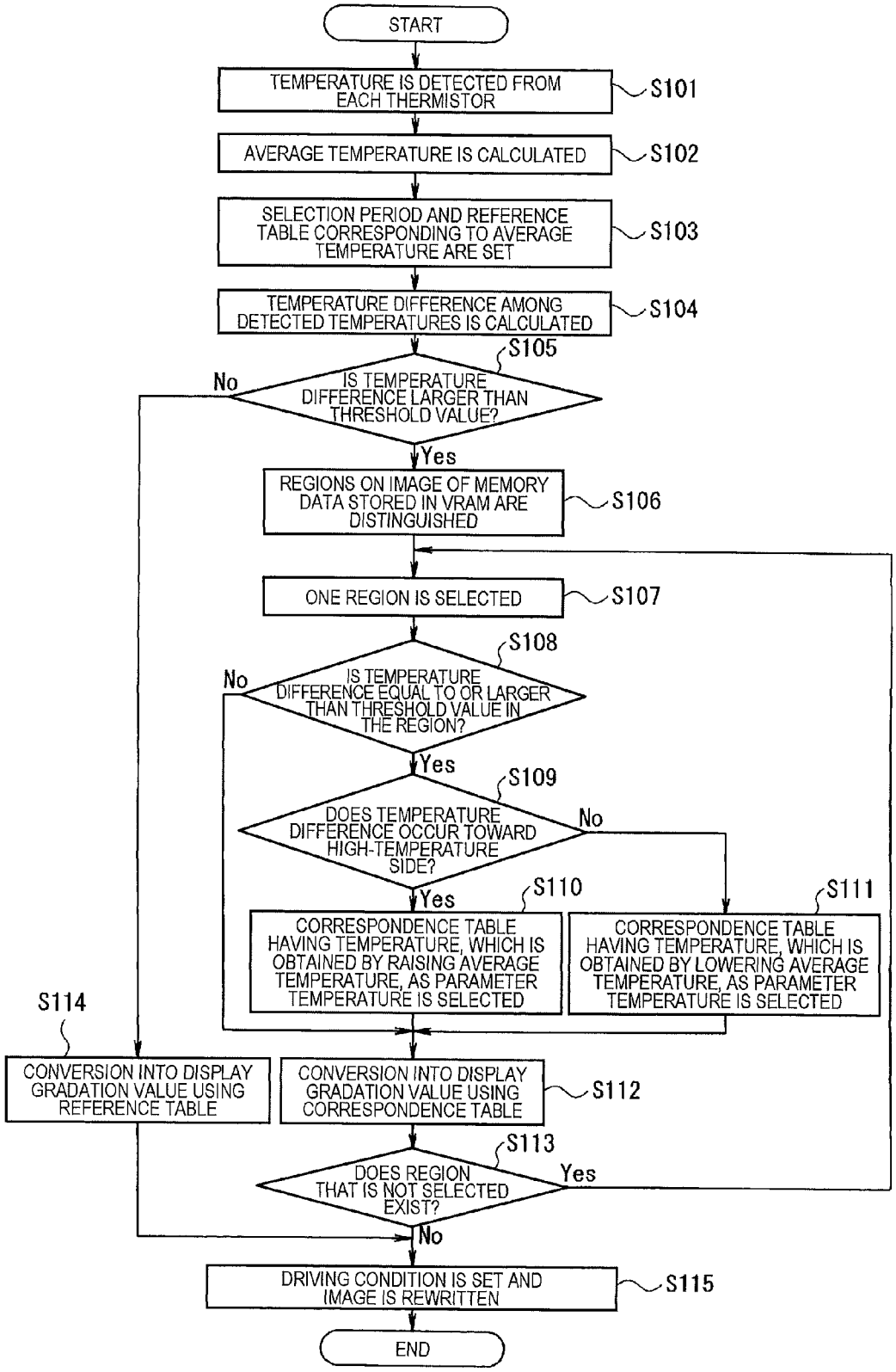
FIG. 7 is a flow chart explaining an operation of an image display apparatus in a first example.

The CPU 41 starts operating when the image rewriting button 5 is pressed, and thus the processing starts. Moreover, in the processing flow chart in the second example shown in FIG. 9, steps in which the same processing as that in the processing flow chart in the first example shown in FIG. 7 is performed are denoted by the same reference numerals. That is, since processing steps (for example, step S101, step S102, and the like) other than steps S103*a*, S110*a*, S111*a*, S112*a*, and S114*a* are equal to those described in FIG. 7, a detailed explanation thereof will be omitted. Accordingly, details of processing in different steps will now be described.

If the processing starts, first, in step S101, a process of detecting temperatures from thermistors as the temperature sensors 31A to 31E is performed. Then, in step S102, a process of calculating the average temperature from the detected temperature, and then in step S103*a*, a Selection period and a gamma value corresponding to the calculated average temperature are set. In this case, a value that is stored beforehand as a default value in the ROM 43 is set as the gamma value.

The gamma value will now be described. Assuming that a pixel gradation value is X and a display gradation value is Y, the gamma value is specified to have correspondence relationship of the following expression (1). The gamma value is a parameter required to create a driving voltage waveform and also is a parameter for deciding an effective voltage value applied to a pixel during the Selection in the present embodiment. Specifically, the gamma value is set such that an effective voltage value applied during the Selection period becomes low because the viscosity of liquid crystal molecules becomes low when the temperature is high or the effective voltage value applied during the Selection period becomes high because the viscosity of liquid crystal molecules becomes high when the temperature is low.

$$Y=X^{\gamma} \quad \text{(Expression 1)}$$

Further, in the present embodiment, the pixel gradation value and the display gradation value each indicate a reflectance normalized by setting a state (white state) where the reflectance of a display screen of the display panel 1 is highest as '1' and the lowest state (black state) as '0'. In addition, in the case when image data is a gradation value corresponding to any one of 0 to 255 expressed in eight bits for each pixel, the gradation value '0' may be set as normalized reflectance '0' and the gradation value '255' may be set as normalized reflectance '1', and a value obtained by converting a gradation value of each pixel to a normalized reflectance may be set as a pixel gradation value by means of gradation conversion processing using dither matrix, for example. Moreover, in the present embodiment, pixel gradation values are assumed to be values corresponding to the normalized reflectances (0, ⅓, ⅔, 1) equivalent to four gradation display.

Assuming that a gamma value is '1' in expression (1), each value of a pixel gradation value X having four gray-scale levels is (0, ⅓, ⅔, 1), and accordingly, a value of a display gradation value Y is set to (0, ⅓, ⅔, 1). Then, a Selection voltage corresponding to the value (0, ⅓, ⅔, 1) of the display gradation value is selected.

Figure 10:
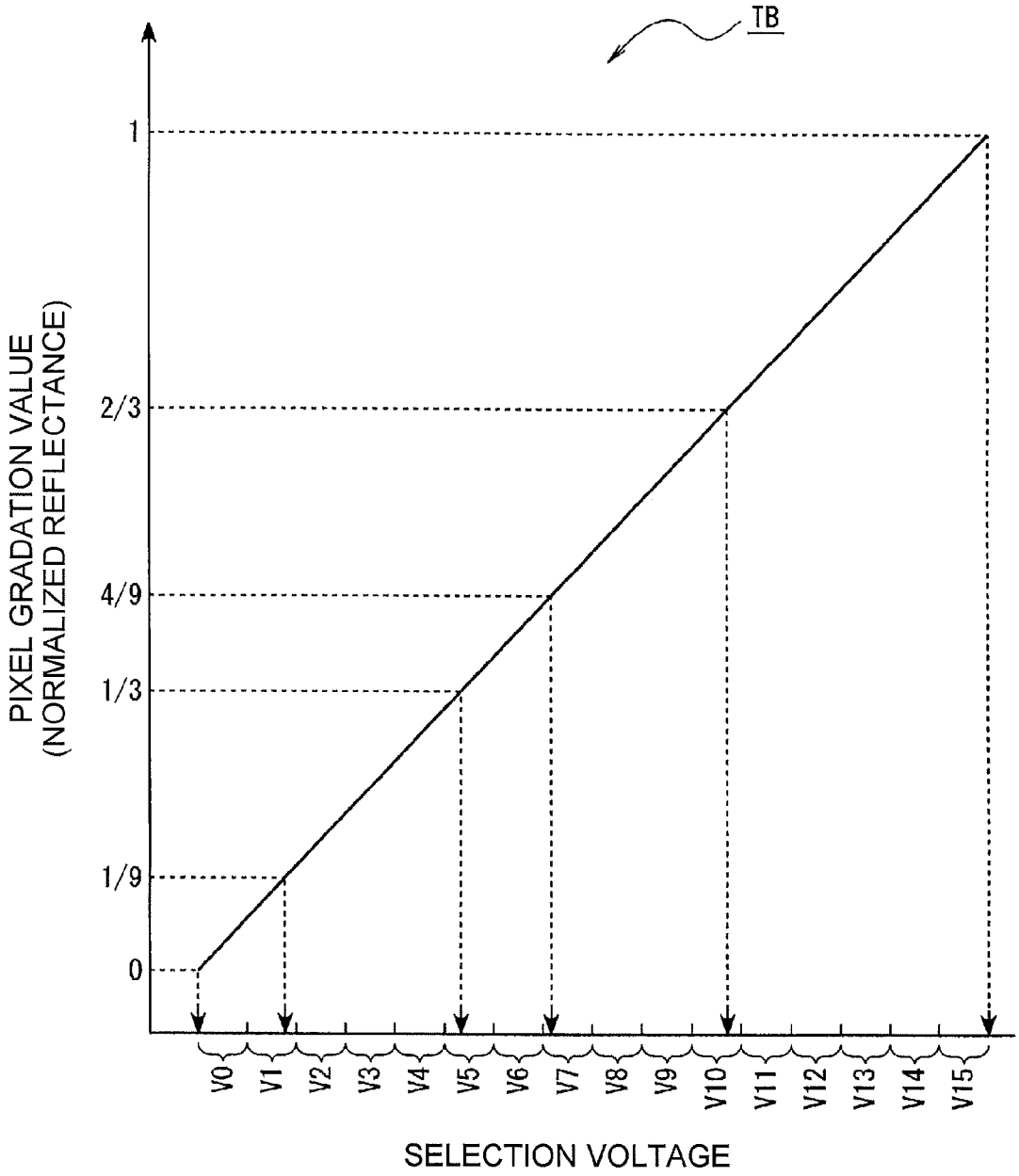
FIG. 10 is a graph illustrating the relationship between the Selection voltage and a display gradation value.

In the present embodiment, the Selection voltage corresponding to the display gradation value is set such that one effective voltage value corresponds to one display gradation value (normalized reflectance), as shown in FIG. 10, and is stored as a predetermined table TB in the ROM 43 (refer to FIG. 1). Therefore, in the case when a gamma value is '1', four kinds of Selection voltages (V0, V5, V10, V15) are selected from the table TB. Then, corresponding to the four gray-scale pixel gradation values (0, ⅓, ⅔, 1) output from the CPU 41, the display driving control circuit 44 outputs 4-bit data indicating the type of each of the Selection voltages (V0, V5, V10, V15) to the display driving circuit 21, as data for deciding an effective voltage value applied to an object pixel during the Selection period. In addition, in a range of the Selection voltage V0 to the Selection voltage V15, an effective voltage value of a corresponding driving voltage waveform is set to increase gradually with a predetermined voltage difference.

Further, in the case when a gamma value is set to '2' larger than '1', each value of the display gradation value Y corresponding to each value (0, ⅓, ⅔, 1) of the four gray-scale pixel gradation value X is set to (0, ⅙, ⅚, 1). Accordingly, corresponding to the four gray-scale pixel gradation values (0, ⅙, ⅚, 1), four kinds of Selection voltages (V0, V1, V7, V15) are selected in FIG. 10. Moreover, the display driving control circuit 44 outputs 4-bit data, which indicates the type of each of the Selection voltages (V0, V1, V7, V15), to the display driving circuit 21.

As can be seen from the above explanation on the gamma value, if the gamma value increases, a display gradation value indicating a middle normalized reflectance approaches to a black side (0), and accordingly, a display image becomes dark. On the other hand, if the gamma value decreases, the display gradation value indicating the middle normalized reflectance approaches to a white side (1), and accordingly, a display image becomes bright.

Hereinbefore, the gamma value has been explained. Next, processing for calculating a temperature difference among detected temperatures is performed in step S104 in FIG. 9, and then processing for determining whether or not the calculated temperature difference is larger than a threshold value is performed in step S105. Thus, a region whose temperature is greatly different from the average temperature is specified.

If it is determined that the temperature difference is equal to or smaller than the threshold value in step S105 (NO), the temperature of the display panel 1 is approximately uniform over the entire five regions. Accordingly, in this case, the process proceeds to step S114 without changing the set gamma value. Then, in step S114*a*, a process of converting image data expressed by a pixel gradation value into a display gradation value indicating a driving condition is performed using the set gamma value, proceeding to step S115.

On the other hand, if it is determined that the temperature difference is larger than the threshold value (step S105: YES), a process of distinguishing the regions 1 to 5, which are shown in FIG. 4, in the image data that is transmitted from the GPU 46 and is stored in the VRAM 45 is performed. Specifically, for example, the regions 1 to 5 can be distinguished by specifying the positions of segment driver and common driver that apply a voltage to pixels in each region.

Then, in step S107, a process of selecting one of the regions 1 to 5 is performed. Subsequently, in step S108, it is determined whether or not the temperature difference between the temperature of the selected region and the average temperature is equal to or larger than the threshold value. If it is determined that the temperature difference is smaller than the threshold value (NO), the process proceeds to step S112*a*. In step S112*a*, image data (pixel gradation value) corresponding to pixels in the selected one region is converted to a display gradation value by using the set gamma value. Data indicating the converted display gradation value is stored in the VRAM 45 for each selected region.

On the other hand, if it is determined that the temperature difference is equal to or larger than the threshold value (step S108: YES), the process proceeds to step S109. In step S109, it is determined whether or not the temperature difference occurs toward the high-temperature side. If it is determined that the temperature difference occurs toward the high-temperature side (YES), processing for changing the gamma value to a low value is performed in step S110*a*. On the other hand, if it is determined that the temperature difference does not occur toward the high-temperature side (NO), the process proceeds to step S111*a* to perform processing for changing the gamma value to a high value, since the temperature difference occurs toward the low-temperature side. Thereafter, in step S112*a*, the image data (pixel gradation value) corresponding to pixels in the selected one region is converted to a display gradation value by using the changed gamma value, and the data indicating the converted display gradation value is stored in the VRAM 45 for each selected region.

For example, assuming that the gamma value set in step S103*a* is '2', in the case when the temperature difference occurs toward the high-temperature side in step S109, the temperature of liquid crystal in a region where the temperature difference occurs is higher than the average temperature. Accordingly, the state easily transitions to the TP alignment due to an effective voltage value applied during the Selection period, resulting in a black display on the whole (changing to the F alignment). In this case, by changing the gamma value to a low value, for example, '1.5' to make a display image entirely bright, the above problem can be solved. As a result, an image having precise and natural gradation can be reproduced (step S110).

In contrast, in the case when the temperature difference occurs toward the low-temperature side in step S109, the temperature of liquid crystal in a region where the temperature difference occurs is lower than the average temperature. Accordingly, the effective voltage value applied during the Selection period does not allow the state to transition to the TP alignment, resulting in a black display on the whole (changing to the P alignment). In this case, by changing the gamma value to a high value, for example, '2.5' to make a display image entirely dark, the above problem can be solved. As a result, an image having precise and natural gradation can be reproduced (step S111).

Then, in step S113, it is determined whether or not a region that is not selected exists. If it is determined that a region that is not selected exists (YES), the process returns to step S107 to select one region that is not selected and then repeat the processes in step S107 to step S113. Then, if it is determined that a region that is not selected does not exist (NO), the process proceeds to step S115.

In step S115, a driving condition is set in each of the regions 1 to 5 by selecting a corresponding Selection voltage with respect to a display gradation value obtained by converting image data of each region using the gamma value. Then, a driving voltage waveform specified by the set driving condition is sequentially applied during the Selection period of each pixel, thereby performing processing for rewriting an image. Thus, processing in the second example is completed.

As a result, in the case when the temperature difference among the regions 1 to 5 of the display panel 1 is large, an image becomes bright or dark with the gamma value set corresponding to the average temperature because the temperature of a liquid crystal material, which is a display material in a region where the temperature difference is large, is different from the average temperature. However, in the example described above, since it is possible to prevent an image from becoming bright or dark by changing the gamma value in the region where the temperature difference is large, an image with satisfactory reproduction can be displayed, and accordingly, it becomes possible to reproduce an image with precise and natural gradation.

In addition, as can be seen in the first example described above, the DDS driving method is not limited to the method shown in FIG. 6A but also includes a case of selecting the alignment state as shown in FIG. 6B. The case shown in FIG. 6B is the same as the case shown in FIG. 6A until the Selection period, but a voltage applied during the Evolution period in the case shown in FIG. 6B is lower than that in the case shown in FIG. 6A. That is, transition of an alignment state during the Evolution period is different from that in the case shown in FIG. 6A. Specifically, the H alignment maintained during the Selection period transitions to the F alignment and the TP alignment transitioned during the Selection period transitions to the P alignment, which is maintained as a final alignment state.

Accordingly, this case is opposite to that described above. That is, in the case when the temperature difference occurs toward the low-temperature side, it is not possible to transition to the TP alignment during the Selection period, resulting in a black display on the whole (changing to the F alignment).

In this case, by changing the gamma value to a low value to make a display image entirely bright, the above problem can be solved. As a result, the precise and natural gradation can be reproduced. On the other hand, in the case when the temperature difference occurs toward the high-temperature side, the state transitions to the TP alignment during the Selection period, resulting in a white display on the whole (changing to the P alignment). In this case, by changing the gamma value to a high value to make a display image entirely dark, the above problem can be solved. As a result, an image with precise and natural gradation can be reproduced.

(E) Third Example of Temperature Compensation in the Present Embodiment

In the first and second examples, it has been described about examples of correcting the gradation display having four gray-scale levels including a halftone in correspondence with the temperature difference. However, in the case when the temperature difference of each region that occurs actually is larger than the threshold value, it may be difficult to perform gradation display corresponding to the number of gray-scale levels that an image originally has. For example, in a case in which the average temperature itself is considerably high temperature and the temperature difference occurs toward the high-temperature side or a case in which the average temperature itself is considerably low temperature and the temperature difference occurs toward the low-temperature side, an effective voltage value for displaying a halftone may not be set from the sixteen kinds of values controlled by a PWM circuit.

Figure 11:
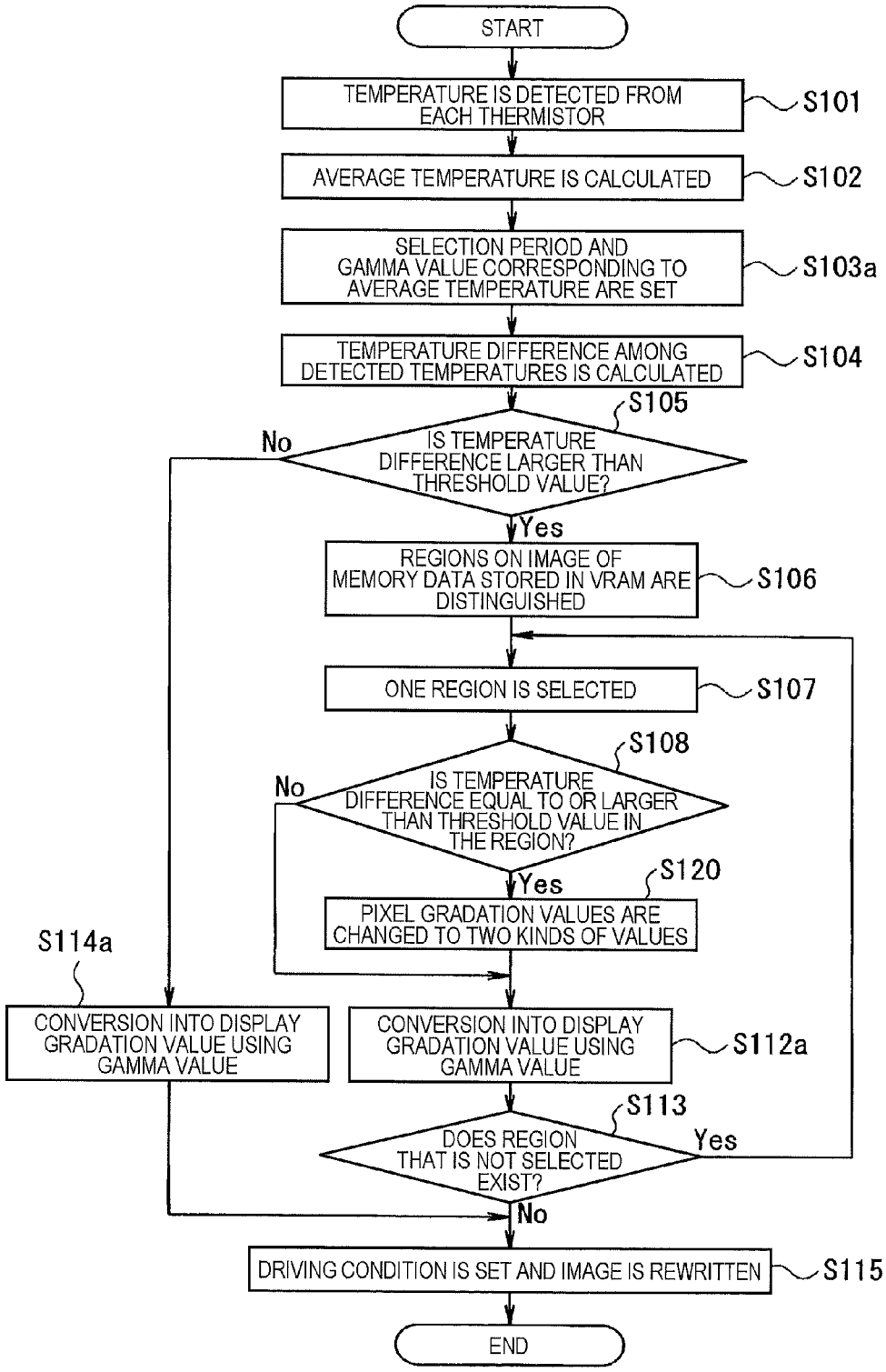
FIG. 11 is a flow chart explaining an operation of an image display apparatus in a third example.

For this reason, in the third example of the temperature compensation performed by the image display apparatus according to the present embodiment, a process of reducing the number of gray-scale display levels is performed corresponding to the temperature difference of the display panel 1. In this case, for example, a halftone (for example, gray color) is changed beforehand to a black or white color, it is prevented that a character becomes thick or thin. As a result, it is possible to display a stable image that is not affected by temperature change. This processing will now be described referring to a flow chart shown in FIG. 11.

Figure 9:
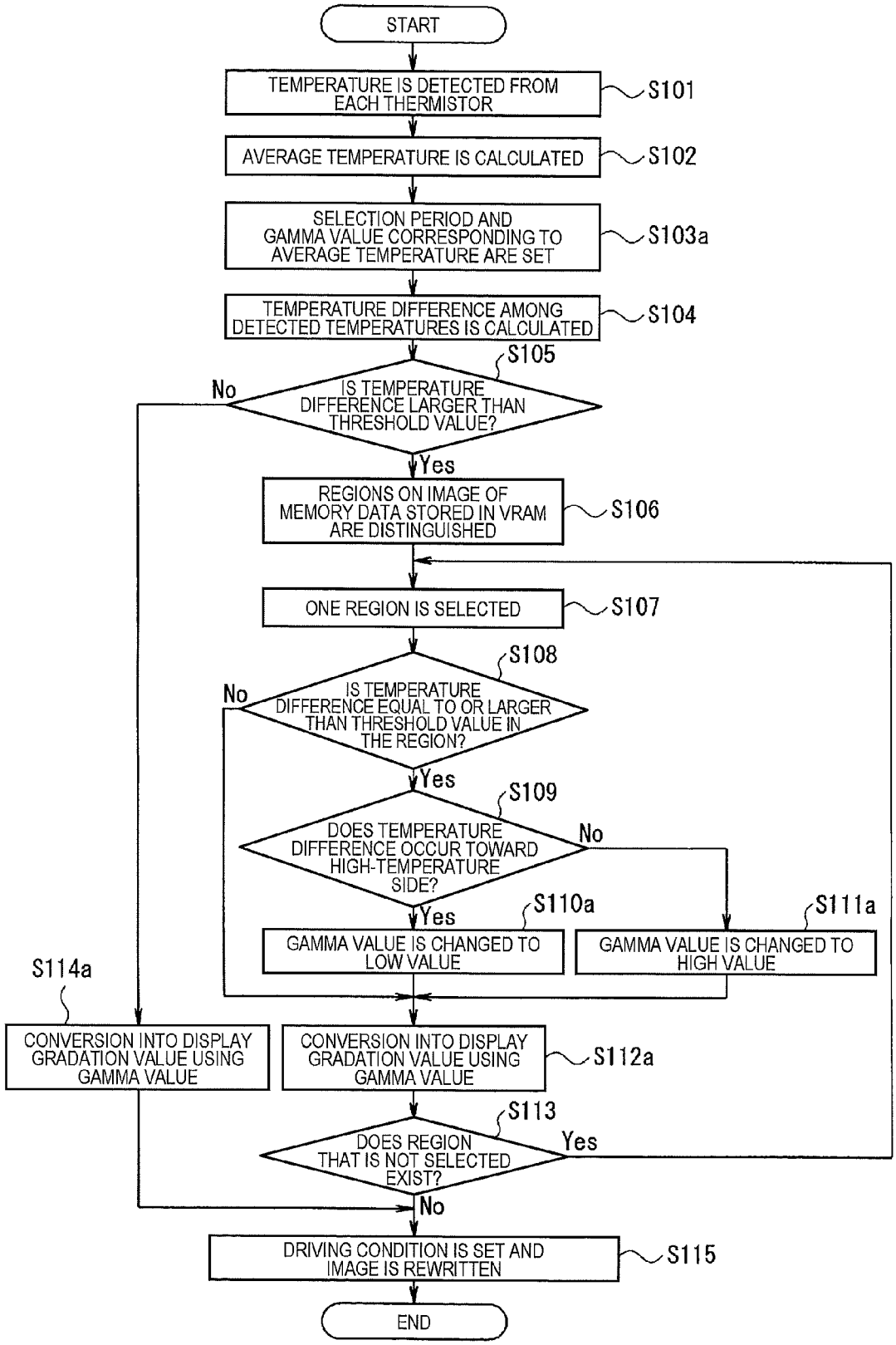
FIG. 9 is a flow chart explaining an operation of an image display apparatus in a second example.

The CPU 41 starts operating when the image rewriting button 5 is pressed and then the started CPU 41 controls the display driving control circuit 44 or the like according to a predetermined program, such that the processing is executed. In addition, in the processing flow chart in the third example shown in FIG. 11, steps in which the same processing as that in the processing flow chart in the second example shown in FIG. 9 is performed are denoted by the same reference numerals. That is, since the same processes as those described in FIG. 9 are performed in steps S101 to S108 and steps S112 to S115, an explanation thereof will be omitted. Accordingly, details of processing in different step S120 will now be described.

In the third example, if it is determined that the temperature difference is equal to or larger than a threshold value in step S108 (YES), a process of changing a pixel gradation value to a binary value is performed in step S120. In the second embodiment, the number of gray-scale levels displayed on the display panel 1 has been set to four. That is, when rewriting an image, display gradation values obtained by converting the pixel gradation values (0, ⅓, ⅔, 1) of pixels are also converted into four kinds of gradation values corresponding to the set gamma value, and four kinds of Selection voltages corresponding to the converted display gradation values are selected.

In the third example, when the display driving control circuit 44 changes the pixel gradation values as image data to display gradation values on the basis of the gamma value, the display driving control circuit 44 changes beforehand the pixel gradation values (0, ⅓, ⅔, 1) corresponding to four kinds of gray-scale levels to two kinds of pixel gradation values. In this example, the pixel gradation value (⅓) is changed to a pixel gradation value (0) and the pixel gradation value (⅔) is changed to a pixel gradation value (1). As a specific processing method, as described above, in the case when image data is a gradation value corresponding to any one of 0 to 255 expressed in eight bits for each pixel, the gradation value is binarized to '0' and '255' by means of gradation conversion processing using dither matrix for binarization, and processing for conversion to pixel gradation values corresponding to normalized reflectance '0' and normalized reflectance '1' is performed.

As can be seen from the above explanation, the pixel gradation value (0) is changed to a display gradation value (0), and the pixel gradation value (1) is changed to a display gradation value (1), regardless of the gamma value. As a result, as shown in FIG. 10, the voltages V0 and V15 indicating effective voltage values corresponding to the display gradation values (0) and (1) are selected as the Selection voltage. Accordingly, since it becomes possible to select the alignment state of liquid crystal stably for each pixel, a black display (in this case, normalized reflectance is 0) or a white display (in this case, normalized reflectance is 1) can be stably realized. As a result, since the pixel gradation value (⅓) causes the white display or the pixel gradation value (⅔) causes the black display, it is prevented that a character becomes thick or thin. Therefore, it becomes possible to display a stable image without depending on the temperature difference of the display panel 1.

Thus, in the third example, in the case when the temperature difference among a plurality of display regions on the display panel 1 is large, halftone gradation values showing, for example, a gray color are converted beforehand into two kinds of gradation values indicating a white color or a black color in a region where the temperature difference is large, such that a line of a character is not thick or thin, thereby reducing the number of gray-scale display levels. As a result, even in a region where the temperature difference between display regions is larger than a threshold value, it is possible to display an image with satisfactory reproduction in which a line of a character is not thick or thin even though it is difficult to realize antialiasing due to the binary image. Moreover, in regions other than the region where the temperature difference is large, the process of reducing the number of gray-scale display levels is not performed. Accordingly, an image with satisfactory reproduction can be displayed.

Although the invention has been described with reference to the embodiment and examples thereof, the invention is not limited thereto but various changes and modifications thereof may be made without departing from the spirit and scope of the invention. Hereinafter, modifications will be described.

First Modification

In the embodiment described above, as shown in FIG. 1, pixel gradation values replaced with normalized reflectances have been set as the image data, which is generated by the GPU 46 and stored in the predetermined region of the VRAM 45, without changing the pixel gradation values. Then, the pixel gradation value is converted into a display gradation value corresponding to the correspondence table or the gamma value that is set or changed, and the Selection voltage is selected corresponding to the converted display gradation value. For this reason, if a set correspondence table or gamma value changes, a converted display gradation value also changes to a different value. Accordingly, as the number of display gradation values that are different increases, the number of kinds of corresponding Selection voltages also increases. Thus, in the present embodiment described above, sixteen kinds of 4-bit Selection voltages are prepared. Therefore, in order to apply effective voltage values corresponding to the sixteen kinds of Selection voltages to pixels to be driven, the PWM circuit generates sixteen kinds of driving voltage waveforms obtained by changing the pulse width of an output voltage pulse to correspond to sixteen kinds of pulse widths.

In general, the smaller the number of kinds of driving voltage waveforms applied to the display panel 1 is, the easier processing for generating the driving voltage waveforms is. Moreover, although not explained details, if the number of kinds of driving voltage waveforms is small, it is possible to suppress a factor that degrades the display image quality called crosstalk. In addition, in the first modification, it may be possible to reduce the number of kinds of Selection voltages, that is, the number of kinds of driving voltage waveforms and to allow only a driving voltage waveform, which has a pulse width set in advance, to be applied to a pixel.

In this case, since a driving voltage waveform different from that corresponding to gradation to be originally displayed is applied to a pixel, gradation different from that to be originally displayed is displayed. Therefore, in this modification, image data different from that stored in a predetermined region of the VRAM 45 is generated. At this time, after the pixel gradation value, which is obtained by converting the generated image data into normalized reflectance, is converted into the display gradation value corresponding to a set gamma value, the converted display gradation value is maintained to be the same all the time. Thus, since the Selection voltage that is selected is always the same, only a driving voltage waveform, which has a pulse width set in advance, is to be applied to a pixel at the time of rewriting of an image.

Next, an image display apparatus according to the first modification will be described. The image display apparatus according to the first modification is different from the image display apparatus 100 in that the GPU 46 in FIG. 1 performs processing for changing and generating the image data stored in the VRAM 45 corresponding to the set or changed correspondence table or gamma value. Therefore, the functional configuration of the image display apparatus according to the first modification is basically the same as the image display apparatus 100 according to the above-described embodiment shown in FIG. 1.

Specifically, in the image display apparatus 100 that functions as, for example, the first modification, the GPU 46 performs processing for changing and generating image data, which is already generated and stored in a predetermined region of the VRAM 45, on the basis of the set gamma value. At this time, the generated image data of each pixel is changed and generated corresponding to the gamma value such that a display gradation value specified by the set gamma value becomes a value that is set beforehand corresponding to a pixel gradation value, and then the changed image data is stored again in the predetermined region of the VRAM 45.

For example, in the case of performing processing according to this modification in the processing in the second example shown in the flow chart of FIG. 9, image data is generated before performing processing in steps S112*a* and S114*a* after step S103*a* such that a pixel value allowing a display gradation value after conversion using the set or change gamma value to be a display gradation value, which is set beforehand, is obtained. As an example, in the case when display gradation values Y set beforehand are (0, 1/9, 4/9, 1), the image data is generated such that the pixel gradation value X becomes (0, 1/9, 4/9, 1) if the set or changed gamma value is '1' or the pixel gradation value X becomes (0, 1/3, 2/3, 1) if the set or change gamma value is '2'.

As processing for generating image data, for example, in the case when the set or changed gamma value is '2' with respect to a pixel whose original pixel gradation value X is to be (1/3), a gradation value of the pixel is generated such that the pixel gradation value X becomes (1/3). Then, a display gradation value after conversion becomes (1/9), resulting in a display gradation value that is set beforehand.

On the other hand, in the case when the set or changed gamma value is '1', the display gradation value Y corresponding to a pixel of the pixel gradation value X (1/3) is equally converted to (1/3), resulting in a display gradation value different from that set beforehand. Then, a display gradation value corresponding to the Selection voltage having an effective voltage value nearest to the display gradation value (1/3) is selected. In this modification, assuming that the Selection voltage V7 equivalent to the display gradation value (4/9) has the nearest effective voltage value with respect to the Selection voltage V5 in FIG. 10, the gamma value is '1'. Accordingly, the pixel gradation value (1/3) is changed to the changed pixel gradation value (4/9) equal to the display gradation value. That is, in the case when the gamma value is '1', a gradation value of a pixel is generated such that the pixel gradation value becomes (4/9) with respect to a pixel whose original pixel gradation value is to be (1/3).

By performing such processing for all pixels to change the pixel gradation value of each pixel to the changed pixel gradation value, it is possible to specify the types of driving voltage waveforms. Further, in the above-described processing for generating image data, the display gradation values that are set beforehand are constant values (0, 1/9, 4/9, 1). However, the display gradation values that are set beforehand are not necessarily constant values. For example, as shown in FIG. 10, a value within a range, which has a predetermined range width and in which one Selection voltage is selected, may be set as the display gradation value. This is because one Selection voltage is selected corresponding to a display gradation value having the predetermined range width, as shown in the drawing, and thus it is possible to reduce the kinds of driving voltage waveforms in the same manner as in the case when the preset display gradation values are constant values.

Thereafter, the display driving control circuit 44 performs processing for conversion to the preset display gradation values using the image data and gamma value stored in the VRAM 45 and then outputs a specific Select voltage, which is selected corresponding to the display gradation value, to the display driving circuit 21 at driving timing. Unlike the examples described above, the display driving circuit 21 in this modification includes a PWM circuit that allows a segment driver to output four kinds of PWM outputs corresponding to 2-bit data input, and generates a driving voltage waveform having a pulse width corresponding to the Selection voltage to thereby drive display panel 1. Other processes are the same as those in the processing flow chart shown in FIG. 9.

In the second example described above, a driving voltage waveform having a pulse width of a display gradation value, which is specified by the set or changed gamma value, is applied to a pixel, without changing the correspondence relationship between pixel gradation values and gradation value data of pixels, thereby obtaining proper gradation display corresponding to each pixel. On the other hand, in the first modification, as described above, the display gradation value specified by the set or changed gamma value has been set beforehand by changing the correspondence relationship between pixel gradation values and gradation value data of pixels. As a result, even with a small number of kinds of driving voltage waveforms, it becomes possible to realize proper gradation display corresponding to each pixel.

Furthermore, like the image display apparatus 100 according to the embodiment shown in FIG. 1, in the case when the display driving circuit 21 is configured to be able to generate a larger number of kinds of driving voltage waveforms than the number of gray-scale display levels of an image displayed on the display panel 1, it is advantageous in that the invention can be applied even to general-purpose image data having a large number of gray-scale display levels, such as eight gray-scale levels or sixteen gray-scale levels. In addition, like the image display apparatus 100 as the first modification, even when the display driving circuit 21 is configured to generate only the same number of kinds of driving voltage waveforms as the number of gray-scale display levels of image data, it is advantageous in that the invention can be applied as long as the image display apparatus can rewrite a display image by causing a personal computer and a display to be communicably connected. That is, this is because a GPU of the personal computer can generate image data according to the number of kinds of driving voltage waveforms.

Second Modification

In the first and second examples described above, in the case when the temperature difference is larger than a threshold value on the display panel 1, the temperature and the average temperature in each display region are compared with each other (refer to FIGS. 7 and 9; step S108), and then the correspondence table is selected (refer to FIG. 7; steps S110 and S111) or the gamma value is changed (refer to FIG. 9; steps S110*a* and S111*a*) for a region where the temperature difference is larger than the threshold value. In this modification, in the case when the temperature difference is larger than a threshold value, the Selection period and the reference table is set (refer to FIG. 7; steps S107) corresponding to the average temperature obtained from the temperature measured for each display region (that is, temperature measured by each of the temperature sensors 31A to 31E), and then the correspondence table may be selected or the gamma value may be changed corresponding to the reference table without comparing the temperature in each display region and the average temperature. Thus, it becomes possible to obtain proper gradation display corresponding to the temperature actually measured in a display region.

For example, in the case of applying this modification in the first example, preferably, processing for selecting one region is performed in step S107, a correspondence table corresponding to the temperature measured in the region is selected, and then processes subsequent to step S112 are performed (refer to the flow chart shown in FIG. 7). Further, in the case of applying this modification in the second example, preferably, processing for selecting one region is performed in step S107, a gamma value corresponding to the temperature measured in the region is selected, and then processes subsequent to step S112*a* are performed (refer to the flow chart shown in FIG. 9).

Other Modifications

In addition, the invention is not limited to the embodiment, the examples, and the modification but may be realized as following modifications. For example, even though the embodiment has been described using the cholesteric liquid crystal as a display material and the image display apparatus driven by the DDS driving method, it is possible to use an image display apparatus using other display materials (for example, non-volatile display material in an electrophoretic method) having a steep temperature characteristic. In addition, the invention may be applied to a case of conventionally driving the cholesteric liquid crystal.

Further, in the embodiments and modification described above, temperature obtained by averaging temperatures measured in total five display regions has been set as the average temperature. However, the average temperature is not limited thereto. For example, the measured temperature in a region where the temperature difference with respect to the calculated average temperature is largest may be excluded and temperature obtained by averaging temperatures measured in the rest four regions may be set as new average temperature. Alternatively, the measured temperature in a region having a temperature difference larger than a predetermined threshold value with respect to the calculated average temperature may be excluded and temperature obtained by averaging temperatures measured in the rest regions may be set as new average temperature. Thus, since it is possible to exclude the temperature of a region, in which the temperature difference is large, of all display regions, temperature close to most of the temperatures of the display panel 1 can be set as the average temperature.

Further, in the embodiment described above, as shown in FIG. 3, thermistors are disposed in the middle and four corners of the display panel 1, respectively. However, it is needless to say that the number and positions of thermistors are not limited to those shown in FIG. 3. For example, a more number of thermistors may be disposed or another arrangement place may also be added. The number and arrangement places of thermistors on the display panel 1 may be decided such that temperature of each of the plurality of display regions can be measured correctly.

Furthermore, in the embodiment described above, measurement of temperature of the five regions (regions 1 to 5) that are divided as shown in FIG. 4 has been performed in the measurement of temperature of the display panel 1, but is not limited thereto. For example, it may be possible to increase or decrease the number of regions that are divided or to change the shapes of divided display regions. In this case, it is preferable to measure temperature distribution of a display panel beforehand and then to decide the number or shapes of display regions to be divided according to the measured temperature distribution.

Furthermore, in the third example described above, in the case when there exists a region where a deviation between the temperature and the average temperature exceeds a threshold value, only data of the corresponding region is converted into binary data and halftone is displayed in the other regions. However, binary display may be performed in all regions including a region where the deviation between the temperature and the average temperature is equal to or smaller than the threshold value. Since halftone pixel parts included in characters converted into binary data become white or black, lines of the characters become thin or thick as compared with halftone display characters. For this reason, since a line of a character displayed in a region, in which the deviation between the temperature and the average temperature exceeds the threshold value, becomes thin or thick as compared with lines of characters displayed in the other regions, characters are differently displayed for each region. Therefore, by performing those described above, it becomes possible to prevent lines of a part of characters of an image from becoming thin or thick.

Moreover, in the embodiment described above, when the GPU 46 generates image data, it is possible to perform separation into a character region and an image region such that halftone display is realized in the character region and binary display is realized in the image region. That is, since a large number of gray-scale levels are usually displayed in the image region, the driving voltage waveform applied to a pixel is not appropriate, and as a result, the image cannot be correctly reproduced if original gradation cannot be displayed. However, in the case of the character region, even if a characteristic becomes thin in a region where temperature change is noticeable, the character can be read, such that there is little possibility that nonconformity will occur. On the other hand, in the case of image data of the image region, original image data cannot be correctly reproduced as compared with image data of the character region, and accordingly, there is high possibility that the nonconformity will occur. Therefore, as for the image data of the image region, the display nonconformity appearing in the image region is reduced by converting the image data into binary values beforehand in an appropriate manner.

Furthermore, in the embodiment described above, during the Selection period, application time is varied by changing the pulse width of a driving voltage waveform and an effective voltage value corresponding to gradation to be displayed is applied to a pixel. However, the effective voltage value may be varied by changing an applied voltage value, which becomes amplitude of the driving voltage waveform, without changing the pulse width. Alternatively, both the application time and the applied voltage value may be changed. In this case, driving voltage waveforms having a plurality of kinds of effective voltage values can be generated according to combination of the application time and the applied voltage value.

Furthermore, in the third example of the embodiment described above, when the display driving control circuit 44 converts a pixel gradation value into a display gradation value on the basis of a gamma value, the display driving control circuit 44 changes the four gray-scale pixel gradation values (0, ⅓, ⅔, 1) to two kinds of pixel gradation values (0, 1) beforehand. Here, the third example may also be performed in the case of the first example without being limited to the above case. For example, the correspondence table TA shown in FIG. 8 may be specified such that the pixel gradation values (0, ⅓) correspond to the display gradation value (H0) and the pixel gradation values (⅔, 1) correspond to the display gradation value (H15) for all parameter temperatures. Thus, the pixel gradation values can be easily changed to the two kinds of pixel gradation values (0, 1).

Furthermore, in the embodiment and the third example described above, when converting the pixel gradation value into the display gradation value, the four gray-scale pixel gradation values (0, ⅓, ⅔, 1) are changed beforehand to the two kinds of pixel gradation values (0, 1) indicating 'black color' and 'white color', but is not limited thereto. For example, it may be possible to change the pixel gradation values (0, ⅓) to the pixel gradation value (⅙) and the pixel gradation values (⅔, 1) to the pixel gradation value (⅚). Reflectance or transmittance of the display panel 1 changes with a characteristic of a display material to be used. Therefore, it is preferable to change the pixel gradation values to those corresponding to desired gradation display in accordance with the characteristic of a display material.

In addition, in the embodiment described above, the temperature compensation has been performed for an image whose pixel gradation values are expressed as normalized reflectances (0, ⅓, ⅔, 1) corresponding to four gray-scale levels, but is not limited thereto. For example, the invention may be similarly applied even to an image whose pixel gradation values are expressed in as much as an eight gradation display or an image whose pixel gradation values are expressed in as small as a three gradation display. In addition, it is not necessary that the pixel gradation values are normalized reflectances set to have an approximately uniform distance like (0, ⅓, ⅔, 1).

In addition, even though sixteen kinds of voltages (V0 to V15) have been set as the number of kinds of Selection voltages in the embodiment described above, another number of kinds of voltages (for example, 256 kinds: V0 to V255) may be set. It is preferable to set the number of kinds of Selection voltages in accordance with the number of changeable pulse widths of a PWM circuit or the number of kinds of values of an applied voltage.

In addition, even though the passive driving method has been adopted in the embodiment described above, the examples and the modifications described above may be similarly applied even in an active driving method.

In addition, the image display apparatus 100 according to the embodiment described above is not limited to a case in which the constituent requirements described above are integrally configured. For example, the functions of the embodiments and the modifications described above may be realized by dividing and mounting the constituent requirements into a plurality of apparatuses and then communicably connecting the plurality of apparatuses for cooperation among the apparatuses. For example, in FIG. 1, an image display apparatus may be configured to include: a client device having the display panel 1 and the display driving circuits 21 and 22; and a host device (personal computer) having a function of the control circuit group 4.

The entire disclosure of Japanese Patent Application Nos. 2006-101948, filed Apr. 3, 2006 and 2007-69898, filed Mar. 19, 2007 are expressly incorporated by reference herein.

What is claimed is:

1. An image display apparatus that displays an image on a display, comprising:

a temperature measuring unit configured to measure temperatures of a plurality of display regions of the display;

a determining unit configured to determine whether or not a temperature difference between one of the plurality of display regions and the other display regions is larger than a threshold temperature value on the basis of the temperatures measured by the temperature measuring unit, the determining unit configured to select a selection period for driving the cholesteric liquid crystal based on an average temperature of the plurality of display regions, and after selecting a selection period, configured to determine whether the threshold temperature value for each display region is being surpassed;

a driving condition setting unit configured to set a driving condition for displaying the image on the display according to image data of the image;

a driving condition changing unit that, in a case when the determining unit determines that the temperature difference is larger than the threshold temperature value, is configured to change the set driving condition to a driving condition different from that in a case in which the temperature difference is determined to be equal to or smaller than the threshold value; and a display driving unit that drives the display under the driving condition changed by the driving condition changing unit and displays the image on the display.

2. The image display apparatus according to claim 1, further comprising:

a gradation setting unit that, in the case when the temperature difference is determined to be larger than the threshold value, changes and sets pixel gradation values, which are image data of pixels forming the image, to display gradation values which are image data of pixels forming an image displayed by the display driving unit, wherein the driving condition changing unit changes the set driving condition to a driving condition that is set by the driving condition setting unit using the changed and set display gradation values as image data.

3. The image display apparatus according to claim 2, wherein the gradation setting unit changes and sets the pixel gradation values to the display gradation values for image data displayed on all display regions of the display.

4. The image display apparatus according to claim 2, wherein the gradation setting unit changes and sets the pixel gradation values to the display gradation values for image data displayed on either the one display region or the other display regions.

5. The image display apparatus according to claim 2, wherein the gradation setting unit changes and sets the display gradation values to display gradation values by which the number of gray-scale levels displayed is smaller than that in the case in which the temperature difference is determined to be equal to or smaller than the threshold value.

6. The image display apparatus according to claim 2, wherein the gradation setting unit changes and sets the pixel gradation values to the display gradation values on the basis of a table that specifies correspondence relationship between the pixel gradation values and the display gradation values.

7. The image display apparatus according to claim 6, wherein the gradation setting unit sets display gradation values different from those in the case in which the temperature difference is determined to be equal to or smaller than the threshold value.

8. The image display apparatus according to claim 5, further comprising:

an image creating unit that creates changed pixel gradation values obtained by changing the pixel gradation values so as to be converted into the display gradation values set beforehand, wherein the gradation setting unit performs the changing and setting by using the changed pixel gradation values as the pixel gradation values.

9. The image display apparatus according to claim 1, wherein the driving condition setting unit calculates an average value of the temperatures, which are measured for the other display regions, excluding the measured temperature of the one display region determined that the temperature difference is larger than the threshold value, and sets a driving condition corresponding to the calculated average value as well as the image data of the image.

10. The image display apparatus according to claim 1, wherein the driving condition setting unit sets a driving condition corresponding to the image data from the driving conditions equal to or larger than the number of gray-scale display levels of an image displayed on the display.

11. The image display apparatus according to claim 1, wherein a display material of the display is a liquid crystal material showing a plurality of final alignment states, in which molecular alignments are different, in a final image display state, and the display driving unit causes the alignment states of the molecular alignments to transition to transient alignment states different from the final alignment states and then drives the display using a driving method of selecting the final molecular alignment state during a selection period.

12. The image display apparatus according to claim 11, wherein the display uses cholesteric liquid crystal molecules as a display material.

* * * * *